United States Patent [19]

Fujiwara et al.

[11] Patent Number: 4,995,479

[45] Date of Patent: Feb. 26, 1991

[54] DISPLAY GUIDE APPARATUS OF ELEVATOR AND ITS DISPLAY METHOD

[75] Inventors: Michio Fujiwara; Hiroshi Matsumaru, both of Katsuta; Yasushi Kobayashi, Yokohama; Yoshio Sakai, Ibaraki; Kenzi Yoneda, Katsuta; Osamu Dohi, Katsuta; Akihiko Noguchi, Katsuta, all of Japan

[73] Assignee: Hitachi, Ltd., Tokyo, Japan

[21] Appl. No.: 319,308

[22] Filed: Mar. 6, 1989

[30] Foreign Application Priority Data

Mar. 9, 1988 [JP] Japan ..... 63-53539
Apr. 25, 1988 [JP] Japan ..... 63-100351

[51] Int. Cl.[5] ..... B66B 3/00
[52] U.S. Cl. ..... 187/135; 187/139
[58] Field of Search ..... 187/130, 133, 135, 136, 187/137, 139

[56] References Cited

U.S. PATENT DOCUMENTS

| | | | |
|---|---|---|---|
| 4,149,614 | 4/1979 | Mandel et al. | 187/135 |
| 4,724,932 | 2/1988 | Tauchi | 187/136 |
| 4,724,933 | 2/1988 | Tsuji et al. | 187/137 |
| 4,749,062 | 6/1988 | Tsuji et al. | 187/139 |
| 4,872,532 | 10/1989 | Tobita et al. | 187/130 X |

FOREIGN PATENT DOCUMENTS 2187016 8/1987 United Kingdom .

*Primary Examiner*—A. D. Pellinen
*Assistant Examiner*—W. E. Duncanson, Jr.
*Attorney, Agent, or Firm*—Antonelli, Terry, Stout & Kraus

[57] ABSTRACT

The present invention relates to a display guide apparatus of elevator facilitating alteration of display format and to its display method. A display guide apparatus according to the present invention comprises an elevator control unit, an information producing unit, and an information display control unit. The information display control unit is so configured that an auxiliary memory medium, which has stored therein information required for displaying the running information of the elevator, may be mounted thereon. At least information required for displaying the running information of the elevator is supplied from the auxiliary memory medium. Information required for displaying general information is supplied from the information producing unit. On the basis of information relating to the running situation of the elevator supplied from the elevator contorl unit, the running information of the elevator and the general information are displayed by display units disposed at least at halls to perform guidance.

24 Claims, 20 Drawing Sheets

| | | | |
|---|---|---|---|
| REGISTRATION SPECIFICATION (CHARACTER OR FIGURE?) | REGISTRA-TION NUMBER | PICTURE SIZE DATUM | DISPLAY CONTENTS DATUM (CHARACTER DATUM, COMMAND DISPLAY DATUM, FIGURE DATUM) |

· FOR CHARACTER DATUM, $8 \leqq XL \leqq 160$, $YL = 1, 2, 3$

· FOR FIGURE DATUM, $1 \leqq XL \leqq 160$, $YL = 1, 2, 3$

FIG. 7A

CHARACTER DATUM OF ONE CHARACTER

| | | | | | |
|---|---|---|---|---|---|
| COMMAND DISPLAY DATA | CHARA-CTER COMMA-ND | CHARACTER CODE | CHARA-CTER | CHARACTER CODE | ----- |

FIG. 7B

FIGURE DATUM OF 16x16 DOTS

| | | | | |
|---|---|---|---|---|
| RED LED DATUM | GREEN LED DATUM | RED LED DATUM | GREEN LED DATUM | ----- |

FIG. 8

| REGISTRATION NUMBER | DISPLAYED CHARACTERS |
|---|---|
| 40 | IT IS NOW 0-TH FLOOR |
| 41 | IT IS NOW FIRST FLOOR |
| 42 | IT IS NOW SECOND FLOOR |
| ⋮ | ⋮ |
| | IT IS NOW n-TH FLOOR |

FIG. 9

| REGISTRAT-ION NUMBER | DISPLAYED FIGURE |
|---|---|
| 10 | |
| 11 | |
| 12 | |
| 13 | |
| 14 | |
| 15 | |
| 16 | |
| 17 | |
| 18 | |
| 19 | |

FIG. 10

| REGISTRA-TION NUMBER | DISPLAYED FIGURE |
|---|---|
| 20 | |
| 21 | |
| 22 | |
| 23 | |
| 24 | |
| 25 | |
| 26 | |
| 27 | |
| 28 | |
| 29 | |

| REGISTRATION SPECIFICATION (PICTURE EDIT DATA) | PICTURE NUMBER | REGIST-RATION NUMBER | START POINT DATUM | REGIST-RATION NUMBER | START POINT DATUM | ---- |
|---|---|---|---|---|---|---|

NOTE) THE NUMBER OF REGISTRATIONS : 4

| REGIST-RATION NUMBER | START POINT | |
|---|---|---|
| 2 | X=01 | Y=17 |
| 5 | X=31 | Y=01 |
| 40 | X=131 | Y=01 |
| 50 | X=01 | Y=01 |

( IS HELD IN THE 301-ST CONFERENCE FROM ON THE 30-TH FLOOR )

( RIDE THE ELEVATOR . )

FIG. 23A

| | | |
|---|---|---|
| △ | ○- TH FLOOR | ○ |

| |
|---|
| WAIT ○ SECONDS. |

FIG. 23B

| |
|---|
| CAGE IS NOW ON ○-TH FLOOR. |

FIG. 23C

| |
|---|
| DEGREE OF CONGESTION IS ○ %. |

DISPLAY GUIDE APPARATUS OF ELEVATOR AND ITS DISPLAY METHOD

BACKGROUND OF THE INVENTION

The present invention relates to a display guide apparatus for an elevator, and in particular to an elevator display guide apparatus facilitating alteration of display format at halls and the like on the basis of the desire of a passenger or the like, and its display method.

Various proposals have been made to display not only the running information of the elevator but also general information such as guidance of various events performed in the building in which the elevator is installed and a weather forecast to passengers using the elevator by means of characters, figures and picture patterns using dot images.

In the prior art, an information production unit such as a personal computer is installed in a management room of the elevator, and information required for display is produced by the information production unit and transmitted to display units installed in halls or the like to be displayed there. JP-A-60-16781, JP-A-61-136887, and JP-A-62-196283 relate to the prior art apparatus.

If a passenger makes a complaint that the display format of characters, figures and picture patterns displayed on the display unit is not suitable to the place where the display has been installed, information required for display must be remade by the information production unit.

Since it takes a long time to produce information required for display, it is rather difficult to deal with complaints made by passengers or the like. In particular, the tendency is strengthened as the displayed contents are diversified.

In the above described JP-A-61-136887, alteration of the display information is not mentioned at all.

On the other hand, alteration of display information is explained in the above described JP-A-60-167871 and JP-A-62-196283. In the JP-A-60-167871 and JP-A-62-196283, display information is altered by an input unit or a modification unit corresponding to the above described information production unit, and rapid alteration of figures and picture patterns is impossible.

Further, since figures and picture patterns are displayed by means of dot images, a large number of signals are needed to display them. Since those signals are transmitted to perform display, it is impossible to alter figures and picture patterns at high speed during the display. Display conforming to the running of the elevator is not sufficiently attained.

SUMMARY OF THE INVENTION

An object of the present invention is to provide a display guide method and apparatus for an elevator which facilitates alteration of the display format.

Another object of the present invention is to provide a display guide method and apparatus for an elevator which produces a suitable display even if the building has a number of floors.

Another object of the present invention is to provide a display guide apparatus and method for an elevator in which the display can follow the running of the elevator even if the running of the elevator is intense.

Another object of the present invention is to provide a display guide method and apparatus for an elevator capable of performing display according to the running of the elevator even if the display format comprises complex picture patterns.

In order to achieve the above described objects, an elevator display guide apparatus according to the present invention comprises an elevator control unit, an information production unit, and an information display control unit, the information display control unit being so configured that an auxiliary memory medium storing information required to display running information of an elevator may be mounted thereon, the information display control unit deriving at least the running information of the elevator from the auxiliary memory medium and deriving information required to display general information from the information production unit, and the running information of the elevator and general information being displayed on display units at least disposed in halls according to information relating to the running situation of the elevator supplied from the elevator control unit.

In the auxiliary memory medium, information required to display the running information of the elevator is stored beforehand in various display formats. By replacing the auxiliary memory medium, therefore, the display format appearing on the display units is easily altered.

By preparing a large number of auxiliary memory media, it becomes possible to rapidly respond to various requests.

BRIEF DESCRIPTION OF THE DRAWINGS

FIGS. 7A and 7B show an example of figure data used in the display guide apparatus of FIG. 1.

FIGS. 8 to 10 show an example of relationship among characters, figures and registration numbers displayed by the display unit of FIG. 4.

FIGS. 23A to 23C show variations of characters and figures displayed by the display unit of FIG. 4.

FIGS. 25 and 26 are circuit diagrams showing another embodiment of a display guide apparatus whereby voices are broadcast in synchronism with display of characters, picture patterns and the like.

DESCRIPTION OF THE PREFERRED EMBODIMENTS

An embodiment of the present invention will now be described by referring to FIG. 1.

Figure 1:
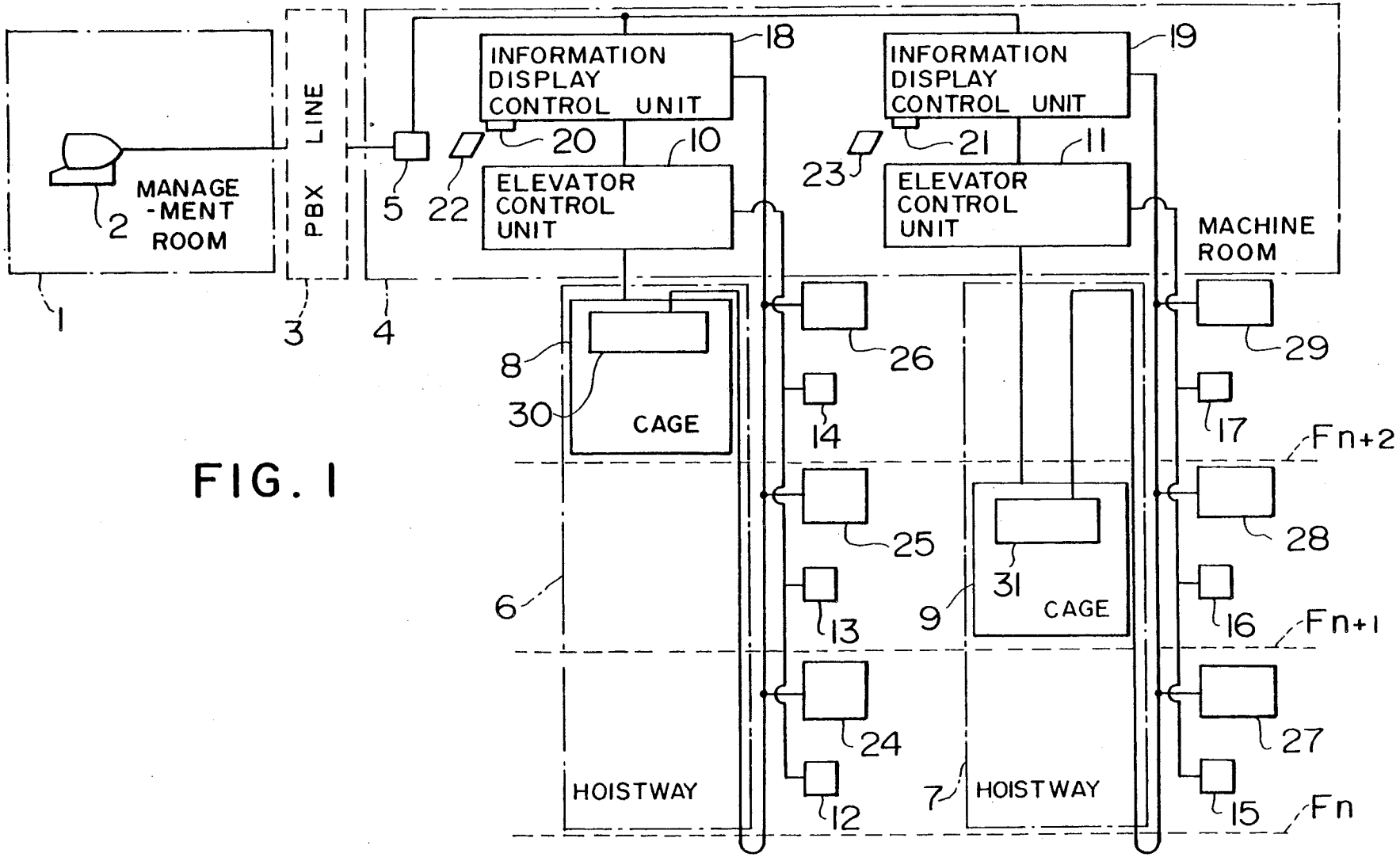
FIG. 1 is a circuit diagram showing an embodiment of a display guide apparatus according to the present invention.

In FIG. 1, numeral 1 denotes a management room, in which a personal computer 2 is installed as an information production unit. In the personal computer 2, information required to display general information which will be described later is produced. Numeral 3 denotes a PBX line, which is connected to a distributor 5 installed in a machine room 4 and the personal computer 2.

Elevator cages 8 and 9 are installed in elevator hoistways 6 and 7 of a building, respectively. Running of the elevator cages 8 and 9 is controlled by elevator control units 10 and 11, respectively. When a passenger depresses any one of hall call buttons 12 to 17 located at halls $F_n$ to $F_{n+2}$, the cage 8 or 9 is served by the elevator control unit 10 or 11. In the machine room 4, information display control units 18 and 19 are installed for the cages 8 and 9, respectively. The information display control units 18 and 19 are respectively connected to the elevator control units 10 and 11 to take in information relating to the situation of running of the cages 8 and 9 from the control units 10 and 11, respectively. Information required to display general information produced by the personal computer 2 is supplied to the information display control units 18 and 19 via the PBX line 3 and the distributor 5. The information display control units 18 and 19 have IC card readers 20 and 21, respectively. The information display units 18 and 19 are so constructed that IC cards 22 and 23 may be mounted thereon and removed therefrom as auxiliary memory media, respectively. As described later, information required to display the situation of running of the cages 8 and 9 is stored on the IC cards 22 and 23, respectively.

At upper parts of elevator gates of the halls $F_n$ to $F_{n+2}$, display units 24 to 29 are installed. Within the cages 8 and 9 as well, display units 30 and 31 are installed. For the cages 8 and 9, display units 24 to 26 and 30, and display units 27 to 29 and 31 are respectively connected to the information display control units 18 and 19 via cables or the like.

For convenience of explanation, only two elevator cages 8 and 9 are shown. However, more elevator cages may be used. In case group control is performed, microprocessors for group control are connected to the elevator control units 10 and 11, respectively.

Instead of the distributor 5 of FIG. 1, telephones for transmitting and receiving signal data, i.e., so-called hybrid phones may be disposed between the personal computer 2 and the PBX line 3 and between the PBX line 3 and the information display control units 18 and 19, respectively.

Figure 2:
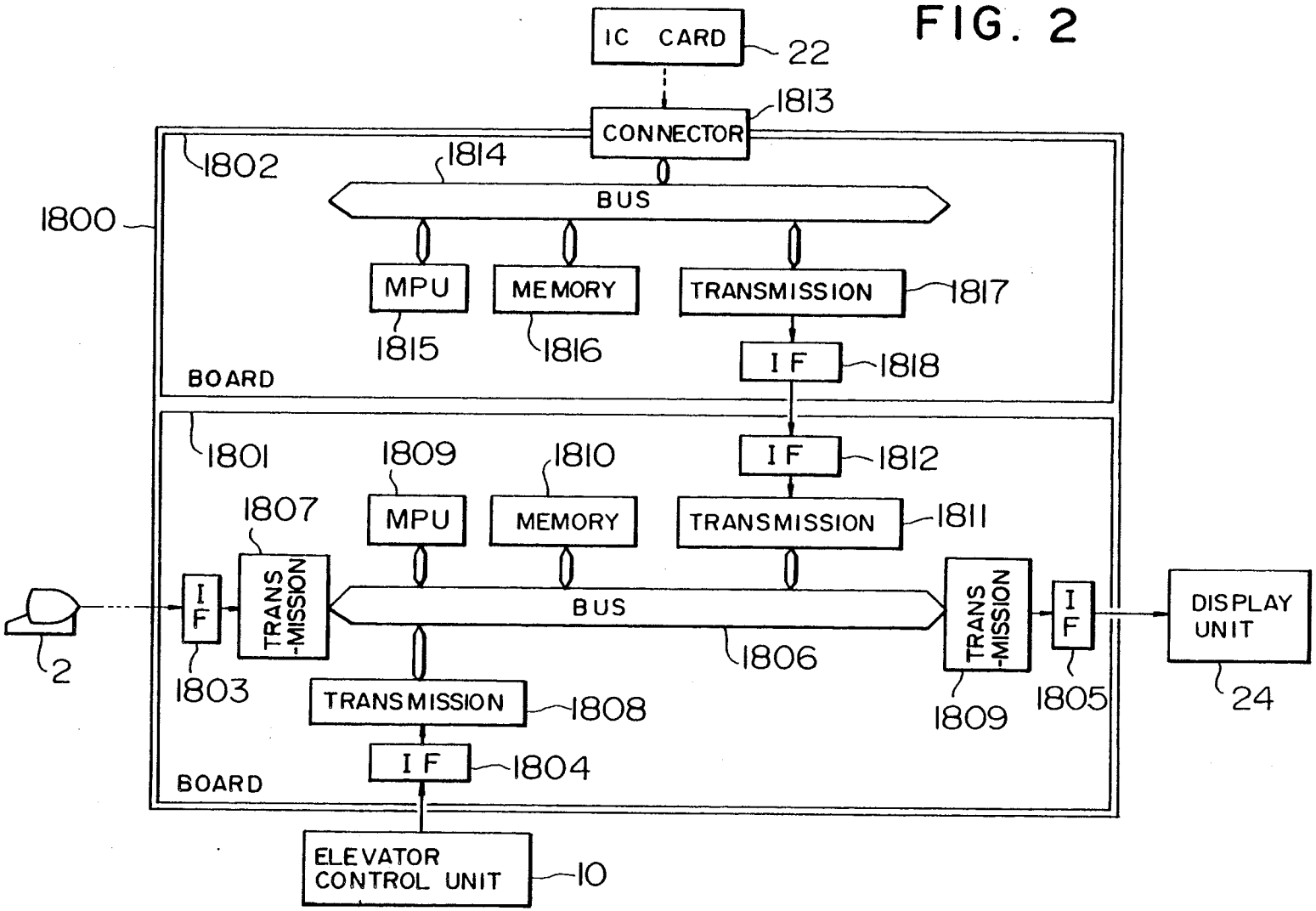
FIGS. 2 to 4 show configuration examples of an information display control unit, an IC card and a display unit used in the display guide apparatus of FIG. 1.

FIG. 2 shows a configuration of the information display control units 18 and 19. Since both of them have identical configuration, they are represented by a block denoted by numeral 1800.

The information display control unit 1800 comprises boards 1801 and 1802. The board 1801 is connected to the personal computer 2, the elevator control unit 10 and the display unit 24 via interfaces 1803 to 1805, respectively. A bus 1806 is connected to interfaces 1803 to 1805 via data transmission sections 1807 to 1809. An MPU 1809 and a memory 1810 are connected to the bus 1806. A data transmission section 1811 is connected to the bus 1806. Further, an interface 1812 is connected to the data transmission section 1811 to perform information transmission with the board 1802. The board 1802 constitutes the IC card reader of FIG. 1. The IC card 22 is coupled to a bus 1814 via a connector 1813.

An MPU 1815 and a memory 1816 are connected to the bus 1814. The bus 1814 is connected to the board 1801 successively via a data transmission section 1817 and an interface 1818.

As described later in detail, the board 1801 takes in information required for display from the personal computer 2, the elevator control unit 10, and the IC card 22 mounted on the board 1802, and transmits the information to the display unit 24 and the like to display the information.

Figure 3:
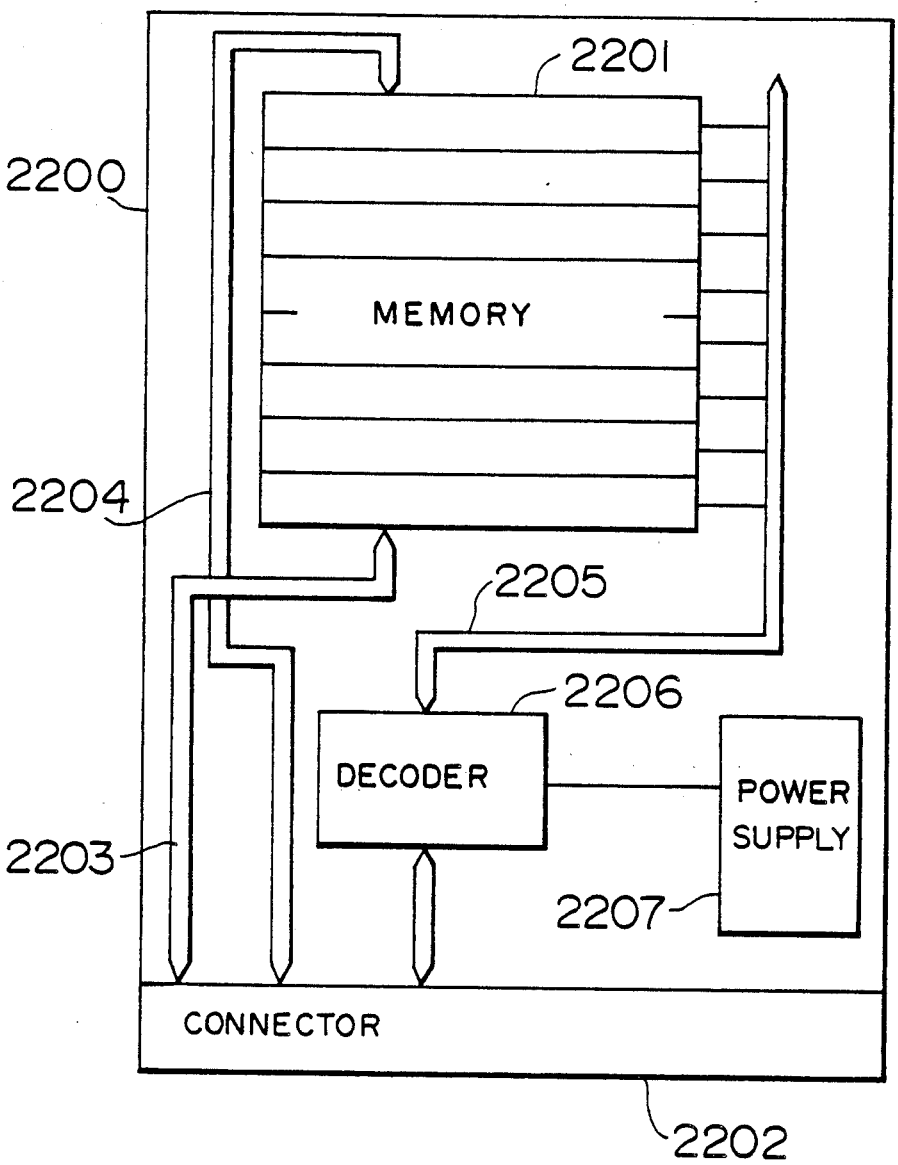

FIG. 3 shows a configuration of the IC cards 22 and 23. Both of them have identical configuration. A representative one denoted by numeral 2200 will now be described.

The IC card 2200 has a memory 2201 and a connector 2202. Between the memory 2201 and the connector 2202, a data bus 2203, an address bus 2204 and a decoder bus 2205 are disposed. A decoder 2206 is disposed on the decoder bus 2205. The decoder 2206 is connected to power supply 2207.

Data inputs and outputs of the IC card 2200 will be described later.

Figure 4:
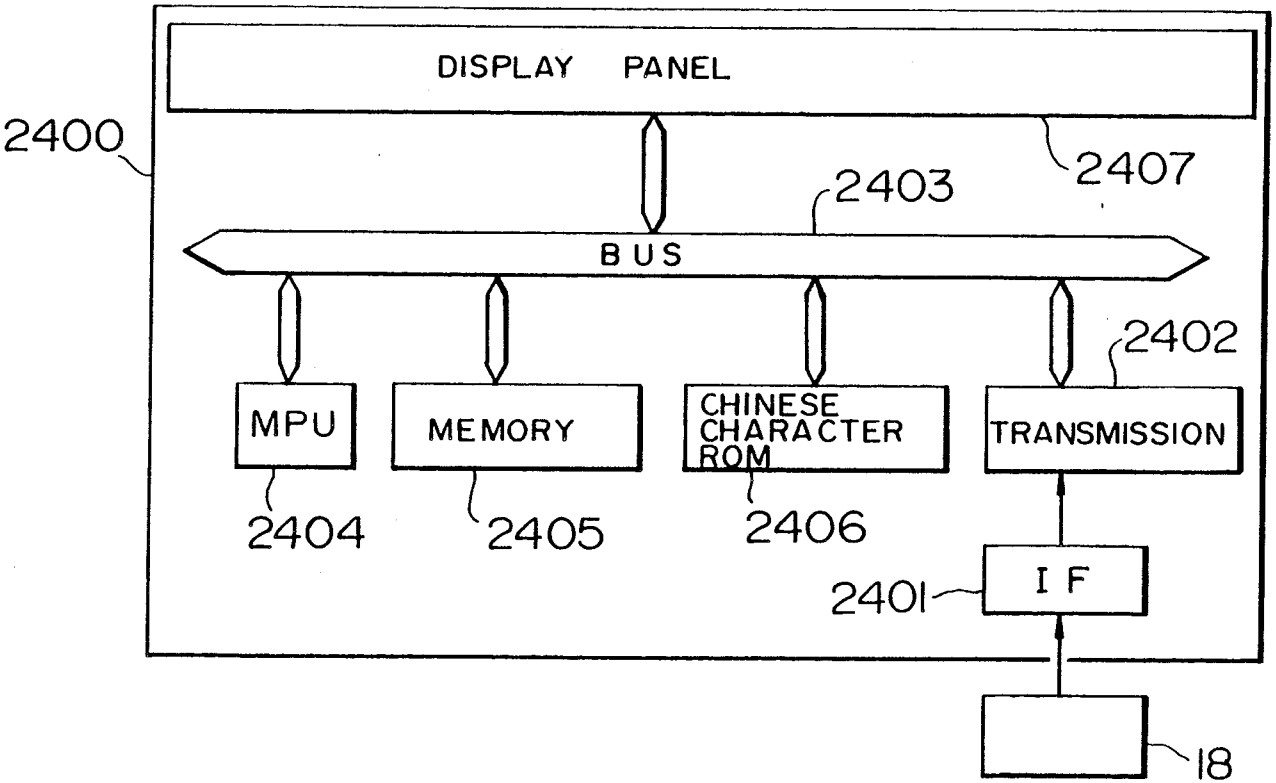

FIG. 4 shows the display units 24 to 31 as numeral 2400.

A bus 2402 is connected to the information display control unit 18 via an interface 2401 and a data transmission section 2402. An MPU 2404, a memory 2405, a Chinese character ROM 2406 and a display panel 2407 are connected to the bus 2403. Chinese characters, alphameric characters and kanas (Japanese syllabaries) of the first and second levels of JIS (Japanese Industrial Standard) are stored beforehand in the Chinese character ROM 2406 in the coded form. The display panel 2407 comprises 3 (longitudinal)×10 (lateral) display modules, i.e., 30 display modules in total. Each display module comprises 16 (longitudinal)×16 (lateral) red light emission diodes (LEDs) and 16 (longitudinal)×16 (lateral) green LEDs.

It is possible to display one character on one display module and display two characters on one display module (i.e., to perform half angle specification). In displaying figures and picture patterns, one display module comprising 16 (longitudinal)×16 (lateral) LEDs is assumed to have dots (i.e., red and green LEDs) arranged in 16 longitudinal columns. Dots in the longitudinal direction are divided into 4 sections each having 4 dots, and an LED lighted in each section is represented by a hexadecimal number. And hexadecimal numbers are arranged in the order advancing from an upper section to a lower section. All of the 16 columns are thus coded. Since two LEDs comprising a red LED and a green LED are present in each dot, both of those LEDs are coded. By controlling the turning on and off of the red and green LEDs, figures and picture patterns are displayed with four kinds of colors comprising red, orange, green and ground colors.

Information required for display will now be described. General information and running information of the elevator are generated in an identical format and displayed. For some display contents, general information is produced by the personal computer 2 immediately before display. Unlike the general information, the running information of the elevator is stored beforehand in the IC cards 22 and 23. However, the running information of the elevator is also generated beforehand by the personal computer or the like before being stored in the IC cards 22 and 23.

General information includes general-purpose information, common information and emergency information. General-purpose information is information specific to the building in which the elevator is installed. The general-purpose information does not change with time and includes event guidance for the building such as the theme, place, day and time of a conference and the menu of a dining hall. Common information is information which is common to buildings and which changes with time such as a weather forecast and news broadcast through a radio or a television set. Emergency information is information conveyed when it has become impossible to use the elevator and relates to occurrence of an accident such as an earthquake or a fire and display guidance in case of trouble.

Running information of the elevator is information representing the current situation of running of the elevator cage such as the degree of congestion of passengers within the cage, waiting time, current position and the direction of running.

These information pieces are supplied with picture numbers every picture displayed on the display panel 2407. Orders of priority are supplied to picture numbers. As an example, higher orders of priority are supplied to information in the order of emergency information, running information of the elevator, common information, and general-purpose information. If picture numbers 1 to 20, 21 to 40, 41 to 50 and 51 to 60 are respectively assigned to general-purpose information, common information, running information of the elevator and emergency information, for example, confusion is not caused when information is changed.

These information pieces may be displayed by characters or may be displayed by figures and picture patterns. Further, characters, figures and picture patterns may be simultaneously displayed.

The format of information required for display will now be described.

Information required for display comprises display data, display picture edit data, schedule data and a file.

All of these pieces of information are converted into digital codes beforehand.

These information pieces will now be described individually.

First of all, display data relate to contents to be displayed and are supplied with a registration number every displayed content.

Figures 5, 6:
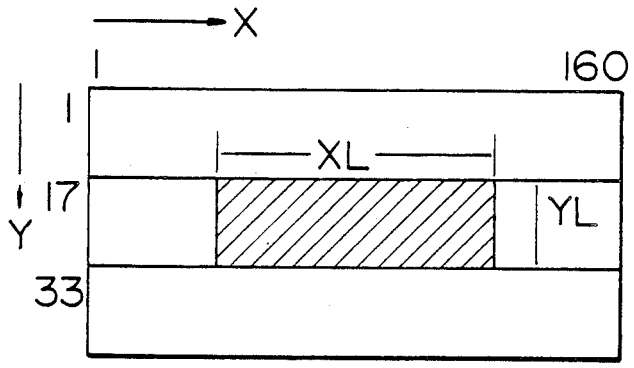
FIG. 5 shows an example of configuration of display data used in the display guide apparatus of FIG. 1.
FIG. 6 is a diagram used for explaining a display panel of the display unit shown in FIG. 4.

As shown in FIG. 5, one display datum comprises registration specification, a registration number, a picture size datum, and a display contents datum.

Registration specification clearly indicates whether contents to be displayed are characters or figures.

When LEDs of the display panel 2407 of the display unit 2400 shown in FIG. 4 are represented by dots in X and Y directions as shown in FIG. 6, the screen size datum specifies a screen size by means of the number of dots XL in the X direction and the number of stages YL. For character data, $8 \leqq XL \leqq 160$ and $YL = 1, 2, 3$, whereas for figure data, $1 \leqq XL \leqq 160$ and $YL = 1, 2, 3$.

The display contents datum comprises a character datum or a figure datum. As described before, the character datum comprises character codes specifying Chinese characters, alphametric characters and kanas (Japanese Syllabaries) of the first and second levels of JIS. The character datum comprises a character command. The character command is placed at the top of the specifying character code to specify the character class as shown in Table 1.

TABLE 1

| CHARACTER COMMAND | CODE | FUNCTION |
|---|---|---|
| COLOR SPECIFICATION | | RED COLOR IS SPECIFIED. |
| | | RED COLOR CAN BE SPECIFIED WHILE TAKING CHARACTER AS UNIT. |
| | | GREEN COLOR IS SPECIFIED. |
| | | GREEN COLOR CAN BE SPECIFIED WHILE TAKING CHARACTER AS UNIT. |
| | | ORANGE COLOR IS SPECIFIED. |
| | | ORANGE COLOR CAN BE SPECIFIED WHILE TAKING CHARACTER AS UNIT. |
| HALF ANGLE SPECIFICATION | | FOLLOWING CHARACTERS BECOME HALF ANGLE. |
| | | ALPHAMETRIC CHARACTERS AND SPACES CAN BE SPECIFIED AS HALF ANGLES. |
| | | FOLLOWING CHARACTERS ARE RESTORED TO FULL ANGLES |
| INVERSION SPECIFICATION | | FOLLOWING CHARACTERS BECOME SKIP CHARACTERS. |
| | | FOLLOWING CHARACTERS ARE RESTORED TO NORMAL. |
| FLICKER SPECIFICATION | | |
| BLANK SPECIFICATION | | BLANK IS INSERTED BETWEEN STRINGS OF CHARACTERS. IN CASE OF HALF ANGLE, BLANK OF HALF ANGLE IS CAUSED. |

In the Table 1, column of code is left blank because it can be arbitrarily specified.

In case characters are displayed, a command display datum is further produced as occasion demands.

A command display datum comprises a scroll display datum and a flicker display datum.

The scroll display datum specifies that characters should be scrolled in the registered picture size and a specified composition should be displayed. Codes are defined as shown in Table 2.

TABLE 2

| COMMAND | CODE | FUNCTION |
|---|---|---|
| SCROLL DIRECTION SPECIFICATION | LEFT: | SCROLL - CHARACTERS IN THE VALUE CONVERTED INTO FULL ANGLE. |
| | RIGHT: | " |
| | UP: | " |
| | DOWN: | " |
| MIDDLE SPLIT SPECIFICATION | | |
| SPEED SPECIFICATION | | SCROLL SPEED IS DEFINED TO BE 80 DOTS/SECOND. 8 KINDS ARE PROVIDED. |
| SCROLL TOP SPECIFICATION | | START OF SCROLL INFORMATION STRING IS INDICATED. |
| SCROLL END SPECIFICATION | | END OF SCROLL INFORMATION STRING IS INDICATED. |
| TEMPORARY STOP | | TEMPORARY STOP OF SCROLL AND ITS TIME ARE SPECIFIED. MAXIMUM VALUE IS DEFINED TO BE 99 SECONDS. |
| SCROLL REPETITION SPECIFICATION | | |

The flicker display datum specifies that characters within the registered picture size should be lighted and extinguished by a command shown in Table 3.

TABLE 3

| COMMAND | CODE | FUNCTION |
|---|---|---|
| LIGHTING AND EXTINGUISHING TIMING SPECIFICATION | | LIGHTING TIME: ____ TO ____ SECONDS EXTINGUISHING TIME: TO ____ TO ____ SECONDS |
| LIGHTING AND EXTINGUISHING TIME SPECIFICATION | | CHARACTERS ARE LIGHTED AND EXTINGUISHED FOR A SPECIFIED TIME. MAXIMUM TIME IS 99 SECONDS. LIGHTING AND EXTINGUISHING TIMING IS MADE EQUIVALENT TO LIGHTING AND EXTINGUISHING DISPLAY. |

In the tables 2 and 3, code columns are left blank because they can be specified arbitrarily.

As described before, the figure datum for displaying the picture pattern is derived by representing dots of 16 longitudinal columns with a hexadecimal number every 4 dots in the longitudinal direction to encode red and green LEDs.

FIGS. 7A and 7B show examples of display contents data obtained when characters and figures (picture pattern) are to be displayed, respectively.

FIGS. 8 to 10 show examples of relations between the registration numbers and displayed characters/figures.

In FIG. 8, the position of the cage is displayed by means of characters. In FIG. 9, the degree of congestion of passengers within the cage is displayed by a figure. In FIG. 10, the running direction of the cage and the position of the cage are displayed by a figure. Since these change moment by moment depending upon the running situation of the elevator, various characters and figures are prepared to respond to the change, and each of them is supplied with a registration number.

Further, display data of basic registration numbers used for registration numbers constituting display picture editing data which will be described later are produced. Basic registration numbers are 40, 10 and 20 respectively shown in FIGS. 8, 9 and 10.

The display screen edit data will now be described.

As described before, each of the pictures displayed on the display panel 2407 is supplied with a picture number. And the number of characters or figures displayed in one picture, i.e. the number of registrations is defined by the number of registration numbers of displayed characters or figures. Coordinates X and Y of a start point of display of each of display data registered in one picture are defined. With reference to FIG. 6, the start point is represented as $1 \leqq x \leqq 153$, $Y=1, 17, 33$ in case of characteristic data. In case of figure data, the start point is represented as $1 \leqq x \leqq 160$, $Y=1, 17, 33$.

When the running information of the elevator is displayed, a basic registration number is used as the registration number. Because contents to be displayed are changed, i.e., the registration number is replaced in response to the situation of running of the elevator cage.

Figures 11, 12:
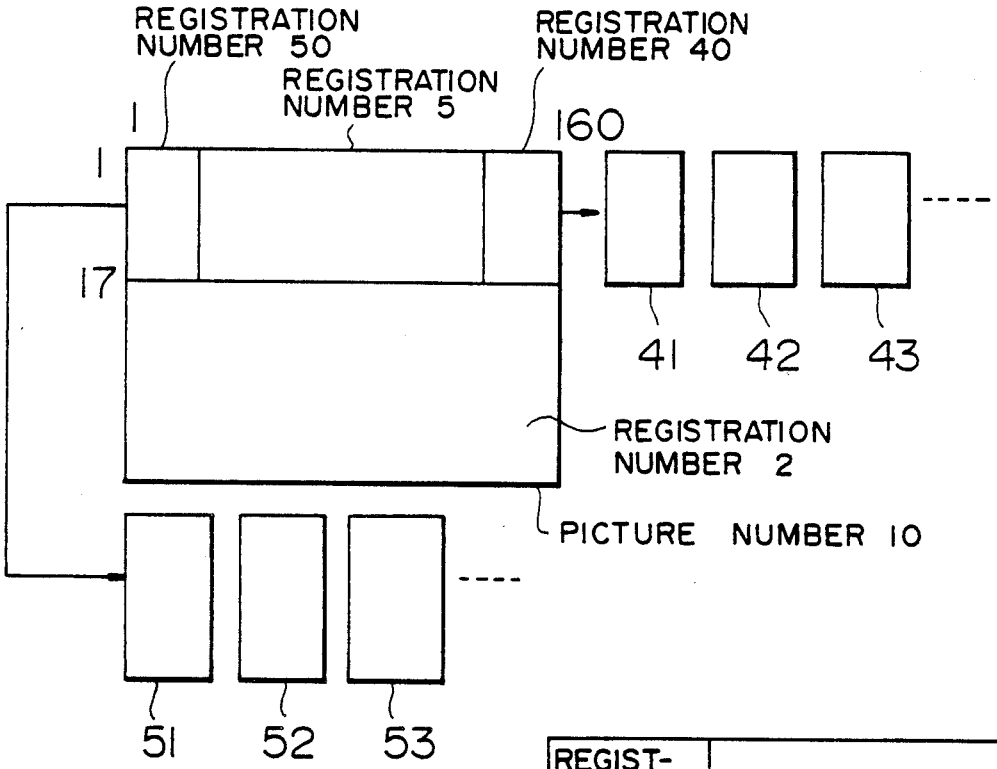
FIG. 11 shows an example of configuration of display picture edition data used in the display guide apparatus of FIG. 1.
FIG. 12 shows an example of configuration of one screen shown on the display unit of FIG. 4.

FIG. 11 shows an example of configuration of display picture edit data.

Registration specification shown in FIG. 11 is a code for clearly indicating that the datum is a display screen edit datum.

Assuming that the display of picture number 10 comprises 4 display data (registration numbers 2, 5, 40, 50), FIG. 12 shows the situation of assignment of information displayed on the display panel 2407, i.e., the situation of picture edit.

Figure 13:
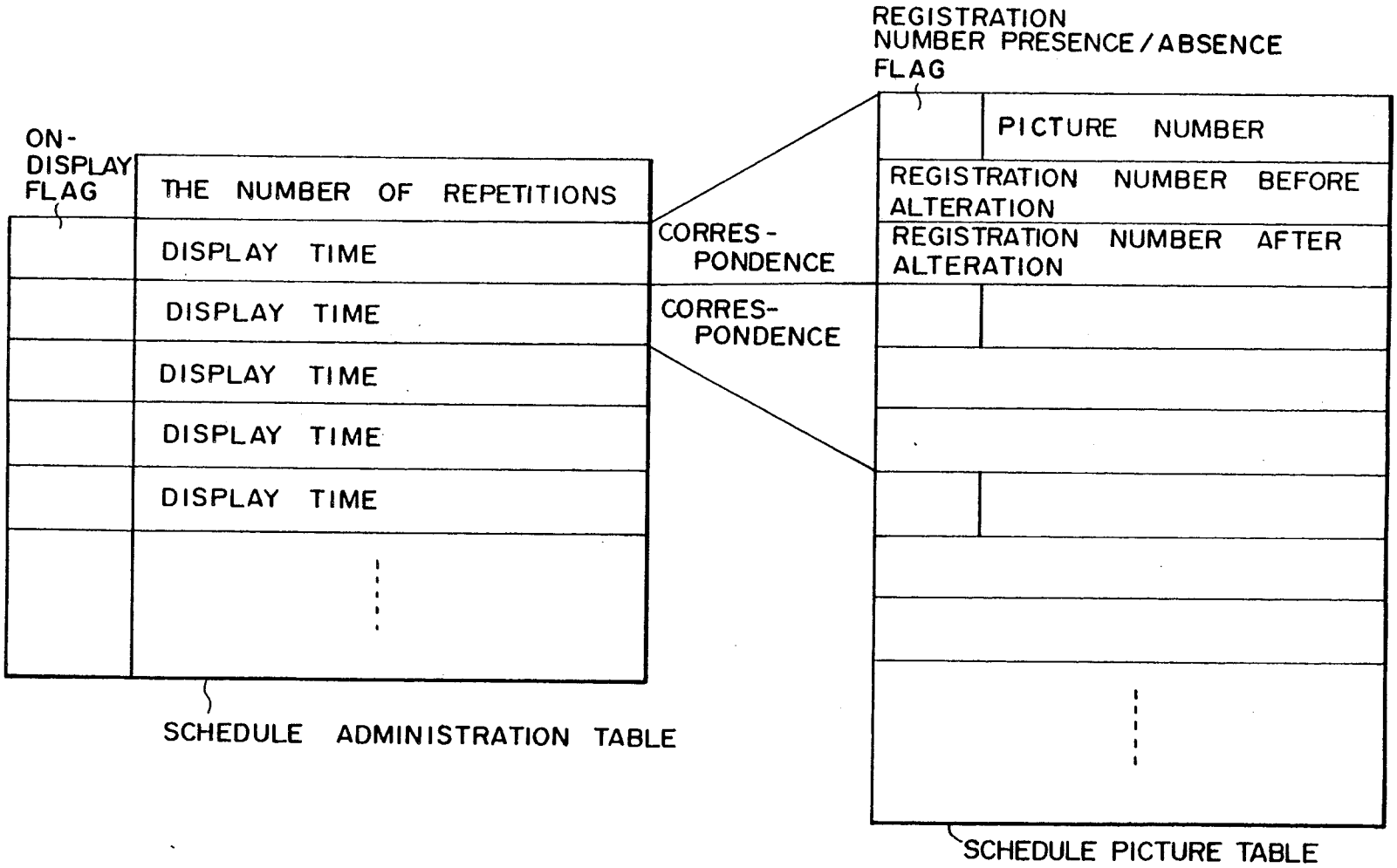
FIG. 13 shows an example of configuration of schedule data used in the display guide apparatus of FIG. 1.

A schedule datum will now be described. The schedule datum specifies the order of display, display time and the number of repetition times of display with respect to display of general-purpose information and common information by using the picture number of each of the above described display picture edit data. A registration number before alteration and a registration number after alteration are added to each picture number be altered. A registration number presence/absence flag for indicating whether the picture number is that for which the registration number alteration should be performed is also provided. A schedule datum is produced for each of the display units 24 to 31. As shown in FIG. 13, a schedule datum comprises a schedule administration table and a schedule picture table. In the schedule administration table, a flag is established for a schedule being displayed.

Lastly, files will now be described.

The situation of elevator running transmitted from the elevator control units 10 and 11 toward the information display control units 18 and 19 is temporarily sent to the information display control units 18 and 19 and then stored in a hall call floor table, a cage position table, a waiting time table, a cage running direction table, a signal sensing table, a cage congestion degree table and the like included in memories of the units 18 and 19. Files serve to convert these situations of running into forms which can be displayed as running information. A display unit number file, a picture number file, a registration number alteration file, a direction file, a waiting time file, a cage congestion degree file, a time picture retrieval file, a priority judgment file are provided.

Relations between the tables and files will be described later in the explanation of display.

The above described various files, display data such as figure data which are difficult to make hastily by the personal computer 2, display data which have a form fixed to some degree and which can be used commonly by buildings or data displaying the situation of elevator running, display picture edit data relating to these display data, and schedule data are stored into the IC cards 22 and 23 beforehand.

Data displaying the situation of the elevator running are stored beforehand on the IC cards by reason that when it is attempted to produce data hastily in the personal computer 2 upon a request of alteration of the display format effective data might be destroyed because of confusion. That is to say, it is easy to produce data calmly beforehand and store the data into the memory of the IC card. The display format can be altered by only replacing the IC card without destroying data. It is thus possible to obtain clear display conforming to the situation of elevator running.

Assuming that a composition is written from left to right like English, display on the display panel 2407 looks well by defining the order of display on the arranged display modules as from the leftmost top end to the rightmost top end, from the leftmost middle end to the rightmost middle end, and from the leftmost bottom end to the rightmost bottom end, for example, and arranging data belonging to each of the above described picture numbers as well in such order.

Figure 14:
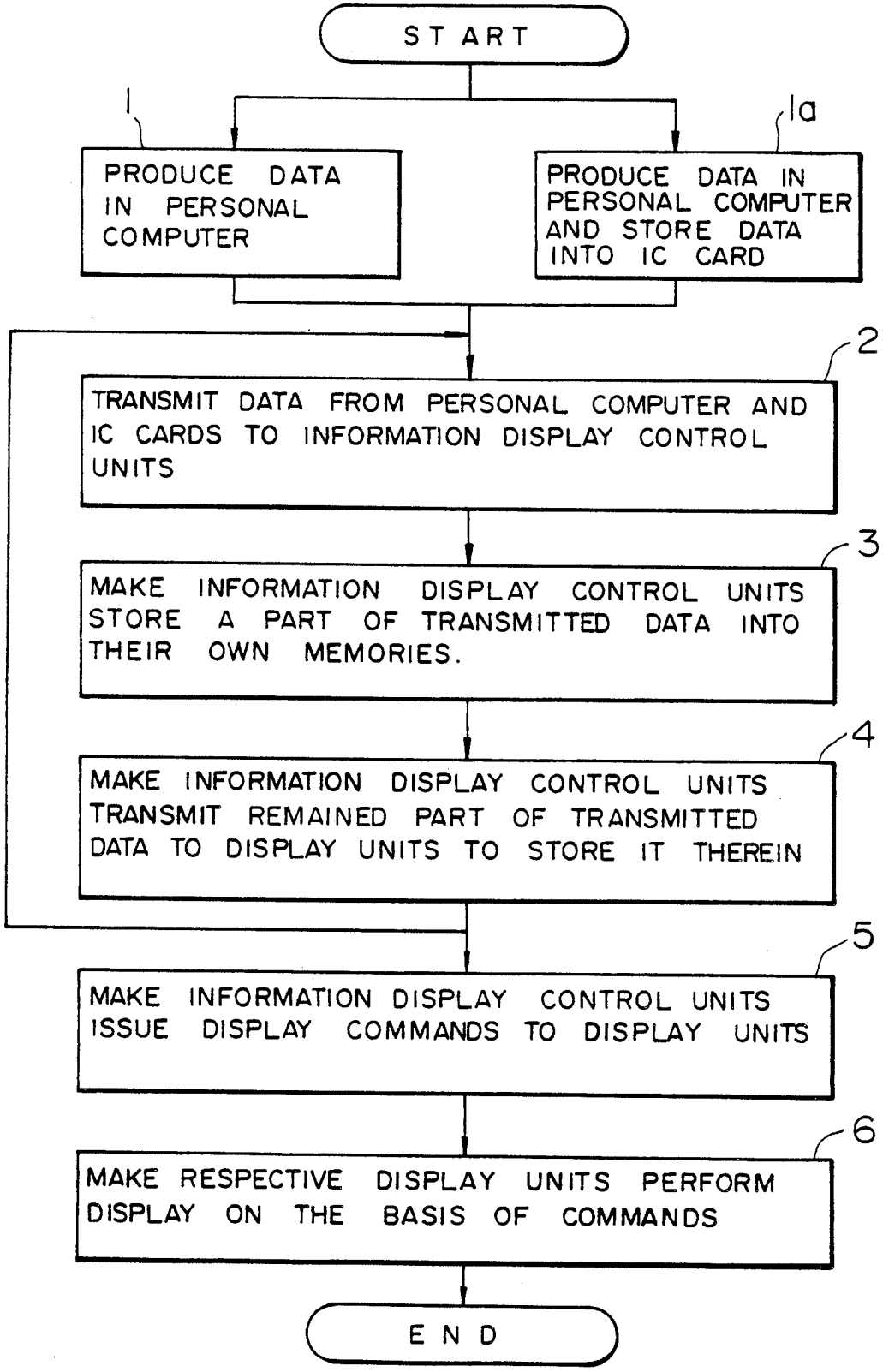
FIG. 14 shows display flow of the display guide apparatus shown in FIG. 1.

The flow of display will now be described roughly by referring to FIG. 14.

First of all, information (data) required for display is produced by the personal computer 2 of FIG. 1 at step 1. On the other hand, information required for display is produced by a personal computer which is not illustrated in FIG. 1 and is stored onto the IC cards 22 and 23 at step la as well. Data are then transmitted from the personal computer 2 and the IC cards 22 and 23 to the information display control units 18 and 19 at step 2. The information display units 18 and 19 store a part of the data thus transmitted into their own memories at step 3 and transmit the remaining part of the data to the display units 24 to 31 to store it therein at step 4. The above described steps 2 to 4 are repeatedly performed depending upon buffer capacities of the memories of the information display control units 18 and 19. (Details will be described later.) At step 5, the information display control units 18 and 19 issue display commands to the display units 24 to 31. On the basis of the commands, the display units 24 to 31 perform display individually at step 6.

Relationship between the information display control units 18 and 19 and display units 24 to 31 will now be described.

The function and operation of the information display control units 18 and 19 will now be described. The function of the information display control units 18 and 19 is roughly divided into acquiring information required for display from the personal computer 2 and the IC cards 22 and 23, memorizing a part of the information thus acquired, transferring the remaining part of the information to the display units 24 to 31 to store the remaining part into memories of the display units 24 to 31 (data input and output control), and performing guidance display required for the display units 24 to 31 on the basis of the above described information required for display and information relating to the situation of elevator running supplied from the elevator control units 10 and 11 (guidance display control).

First of all, the data input and output control of the IC cards 22 and 23 (steps 2 to 4 of FIG. 13) will now be described by referring to FIGS. 2 and 3.

When the IC card 22 is inserted into the connector 1813, buses 2203 to 2205 of the IC card 2200 are connected to the bus 1814 on the board 1802 via the connectors 2202 and 1813. By using the control program stored in the memory 1816, the MPU 1815 sends a signal indicating data readout and a signal specifying a large number of ROMs of the memory 2201 of the IC card 2200 to the decoder 2206. Thereupon, the decoder 2206 brings the specified RAMs into the read state. Addresses of the specified RAMs are transmitted via the address bus 2204 and a read start address is specified. And data at the specified addresses of the specified RAMs are transmitted to the board 1801 via the data transmission sections 1817 and 1811 as well as the interfaces 1818 and 1812. The memory 1810 of the board 1801 comprises a buffer section and a registration section. The MPU 1809 temporarily stores the transmitted data into the buffer section. When the buffer section becomes full, the MPU 1809 divides the data stored in the buffer section into data to be transferred to the registration section and data to be transmitted to the memory 2405 of the display unit 2400 and make respective data stored in the registration section and memory 2405. When the buffer section becomes empty, data supplied from the board 1802 are stored into the buffer section again. When this operation is repeated and readout and transmission of display data are completed, the display picture edit data and the schedule data file are successively read, stored and transmitted.

Information (data) required for display and produced by the personal computer 2 is read into the buffer section of the memory 1810 via the interface 1803 and the data transmission section 1807 by the MPU 1809. By processing similar to that of data supplied from the IC card 22, the information pieces (data) thus read into the buffer section of the memory 1810 are divided into data to be stored into the registration section and data to be sent to the display unit 2400. All data are thus read, stored and transmitted.

Replacing the IC cards 22 and 23 causes only the result that data of new IC cards are stored into addresses of memories whereat data of old IC cards were stored. In this case, data inputted from the personal computer 2 are not erased at all.

Therefore, data inputted from the IC cards 21 and 23 can be freely replaced in accordance with the opinion of passengers and the like. It is a matter of course that data inputted from the IC card are not erased when data supplied from the personal computer 2 are altered. Therefore, data can be altered freely from the personal computer 2 as well.

Data stored into the registration section of the memory 1810 of the board 1801 are schedule data and file data. Data stored in the memory of the display unit 2400 are display data and display picture edit data. The registration number in the display data and the picture number in the display picture edit data are contents of the file data and are stored into the registration section of the memory 1810.

That is to say, data stored in the memory 1810 of the information display control unit 1800 are used to issue display commands. Data stored in the memory 2405 of the display unit 2400 relates to displayed information. This means that when the information display control unit 1800 issues display commands to the display units, the display units deduce and display contents to be displayed on the basis of the commands. When display is performed, data transmitted from the information display control unit to the display units are minimized so as to quickly respond to the situation of running of the elevator cage.

Even when it is desired to display a complex figure or picture pattern, it is not necessary to transmit a large amount of data at all because only a combination of displays is transmitted instead of transmitting data of the figure or picture pattern itself. It is thus possible to display the figure or picture pattern quickly according to the movement of the elevator cage.

The operation and function of the display units 24 to 31 which have received display commands from the information display control units 18 and 19 will now be described.

In FIG. 4, the MPU 2404 stores display data and display picture edit data transmitted from the information display control unit 18 via the interface 2401 and the data transmission section 2402 into the memory 2405.

When a display command is transmitted from the information display control unit 18 together with specification of a certain picture number, the MPU 2404 senses this display command and searches that picture number out of display edit data in the memory 2405. Further, the MPU 2404 takes out the registration number of display data constituting the picture of that picture number and its start point data out of the display picture edit data.

If a registration number alteration command is already issued, the registration number before alteration taken out is converted into a registration number after alteration. The MPU 2404 then takes out the picture size data and display contents data of respective registration numbers taken out from display data stored in the memory 2405. Lastly, the MPU 2404 displays those display contents data on the display panel 2407 with a picture size represented by the picture size data beginning from a start point represented by the start point data.

The display units 24 to 26, 30, 27 to 29 and 31 are respectively connected to the information display control units 18 and 19 in parallel via cables. As described later, therefore, a command issued by the information display control units 18 and 19 is supplied with a coded display unit number in order to clarify which display unit is the destination of the display command. Therefore, the MPU 2404 of each display unit looks at that code and takes in data only when the MPU 2404 judges that the code relates to itself.

The display operation of the information display control units 18 and 19 as well as the display units 24 to 31 relating to the situation of running of the elevator cages 8 and 9 will now be described.

When the storage of the information (data) required for display has been completed, the MPUs 1809 of the information display control units 18 and 19 performs the schedule display of general-purpose information and common information.

Therefore, the schedule display of general-purpose information and common information will now be described.

The MPU 1809 of the information display control unit 1800 takes out the display time and the picture number of the order 1 of the schedule data of the display unit 2400 of the first floor from the schedule data shown in FIG. 13 and included in the memory 1810. And "1" is set in the on-display flag. When the registration number presence/absence flag is not hoisted, the MPU 1809 issues such a command as to display the display datum of that picture number to the display unit of the first floor. When the registration number presence/absence flag is hoisted, the MPU 1809 sends such a command as to display the display datum of that picture number and such a command as to alter the current registration number of the display datum of that picture number into a registration number after alteration to the display unit of the first floor. In the same way, such commands as to display the first one of the schedule data are successively issued to display units of higher floors such as the second floor and then the third floor.

Whenever the display time of the order 1 of each display unit of the schedule data read out has elapsed thereafter, the picture number and the display time of the next order are read, and display commands are issued to the display units of respective floors in accordance with processing similar to that of the display command of the order 1. If display orders are issued at the same time, however, respective display units are supplied with priority orders, and the display order is issued earlier to a display unit having a higher priority.

When the end of the schedule data has been read, the column specifying the number of repetitions of the schedule data is seen, and such a directive as to display data by returning to the beginning of the schedule data by the number of repetitions is issued.

How to issue a display command in case a call button is depressed at a hall of a certain floor will now be described.

The hall call information generated by depression of any one of the call buttons 12 to 17 is temporarily transmitted to the elevator control unit 10 or 11, and then conveyed to the information display control unit 18 or 19. As well known, the elevator control unit 10 or 11 dispatches the elevator cage 8 or 9 to the hall where call is generated on the basis of depression of the call buttons 12 to 17.

Figure 15:
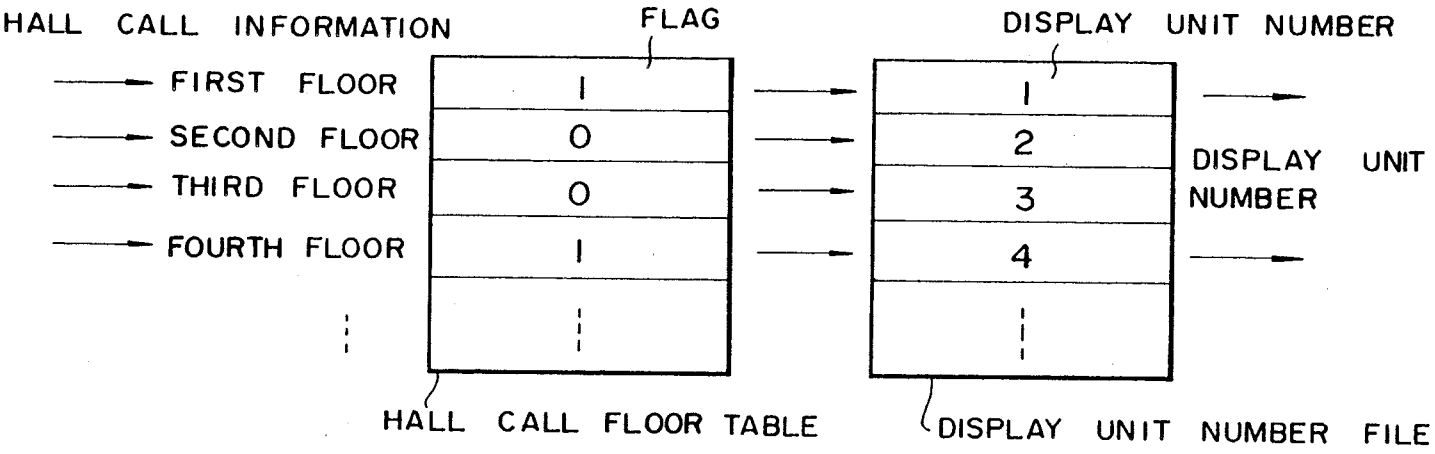
FIGS. 15 to 20 show relations between various tables used in the display guide apparatus of FIG. 1 and files.

In the hall call floor table included in the memory 1810 of the information display control unit 1800, a flag 1 is hoisted on the called floor as shown in FIG. 15.

Figure 16:
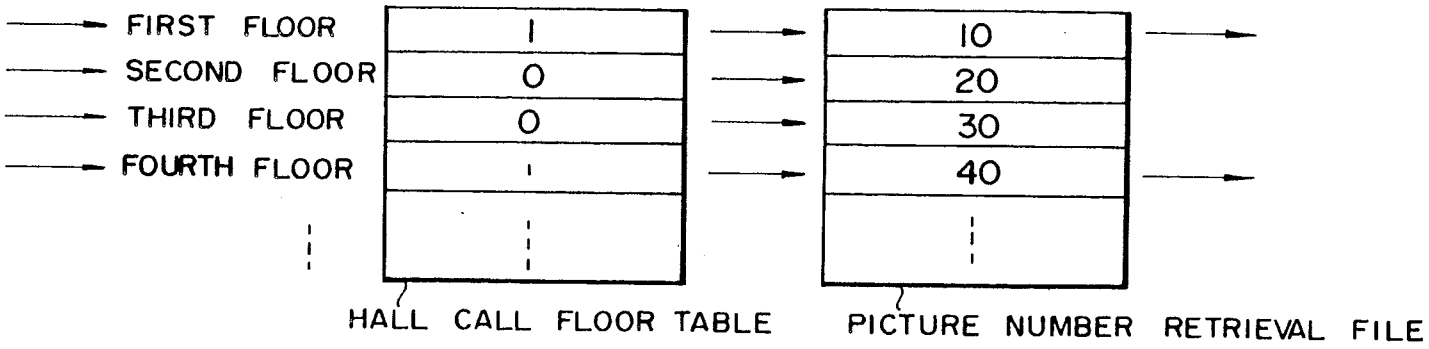

Succeedingly, a display unit number corresponding to the floor having a flag hoisted in the hall call floor table is taken out from the display unit number file included in the memory 1810. Thereupon a display unit whereto a display command should be issued is defined. Further, a picture number corresponding to the floor having a flag set in the hall call floor table is taken out from the picture number retrieval file included in the memory 1810 as shown in FIG. 16.

By the operation heretofore described, the number of the picture to be used for the display unit 2400 of the floor (hall) where the hall call is generated is defined.

Assuming that the display of the cage position, display of the running direction, display of the waiting time and display of congestion degree in the cage are contained in the specified picture, these displays will now be described.

Figure 17:
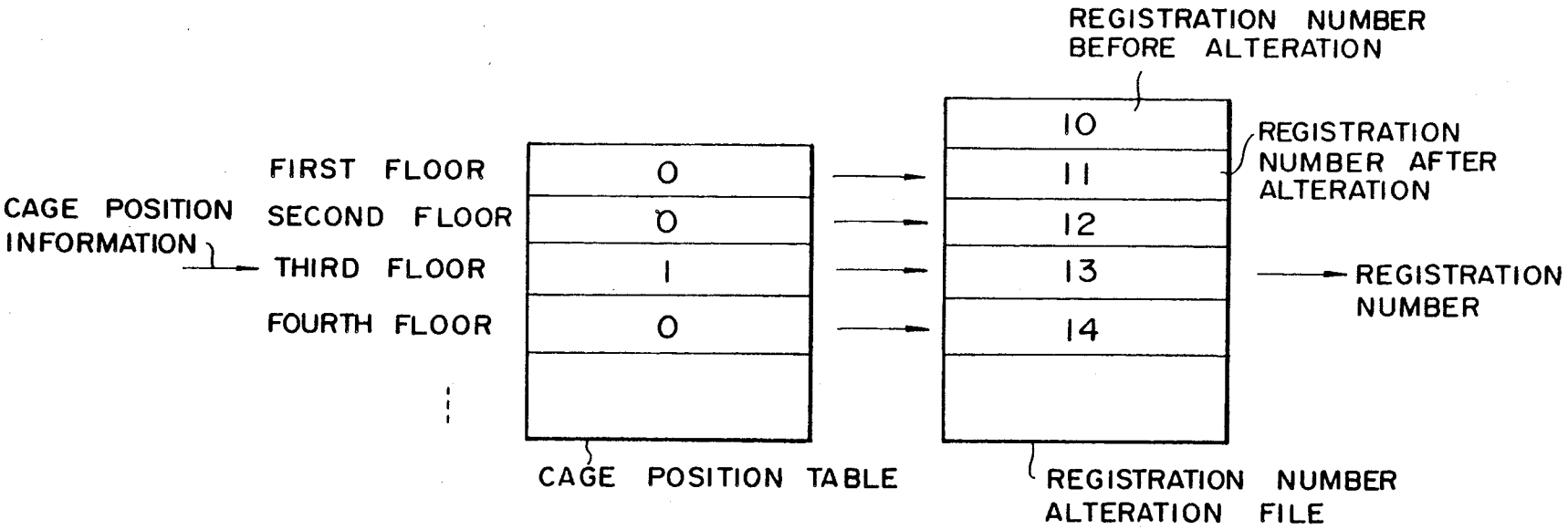

First of all, display of the cage position will be described. In the cage position table contained in the memory 1809 of the information display control unit 1800, a flag is hoisted on the floor where the cage is positioned on the basis of the current position information of the cage obtained from the elevator control unit 10 as shown in FIG. 17. From the registration number alteration file contained in the memory 1809, the registration number after alteration and the registration number before alteration corresponding to the floor having a flag hoisted in the cage position table are taken out. Since the alteration is performed for the first time, the registration number before alteration is the basic registration number which was used when the display picture edit data were produced. Out of some registration numbers belonging to the picture number already taken out, a registration number relating to the display of the cage position is looked for, and a command directing the use of the above described registration number after alteration is issued. And a command directing the display of the above described picture number is issued. These commands are issued to a display unit having the display unit number taken out beforehand. It display units of all floors relating to the called cage should display data, commands are issued successively to those display units in the order of descending priorities supplied to the display units.

Whenever the position of the elevator cage changes, a flag is hoisted on the corresponding floor of the cage position table, and other flags are erased. By using the above described processing, a command using a registration number after alteration is issued.

In each display unit, display data corresponding to the registration number are read out from the memory 2405 on the basis of the above described command, and guidance display is performed from the display panel 2407.

Display of the running direction will now be described.

Figure 18:
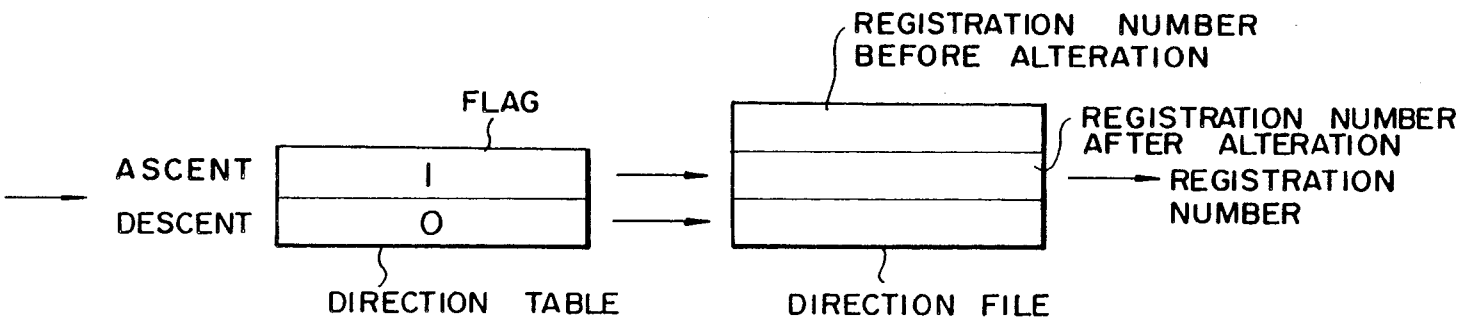

On the basis of the information of the elevator cage derived from the elevator control unit 10, a flag is hoisted in correspondence to the running direction in the running direction table contained in the memory 1810 as shown in FIG. 18. From the direction file of the memory 1810, the registration number after alteration and the registration number before alteration of the current elevator direction are taken out. The registration number relating to the direction of running contained in the picture number taken out beforehand is taken out, and a command for altering the registration number to a registration number after alteration is issued. Whenever the running direction of the elevator changes, the above described processing is performed. On the basis of the alteration command, the display unit 2400 displays the running direction.

Display of waiting timing will now be described.

Figure 19:
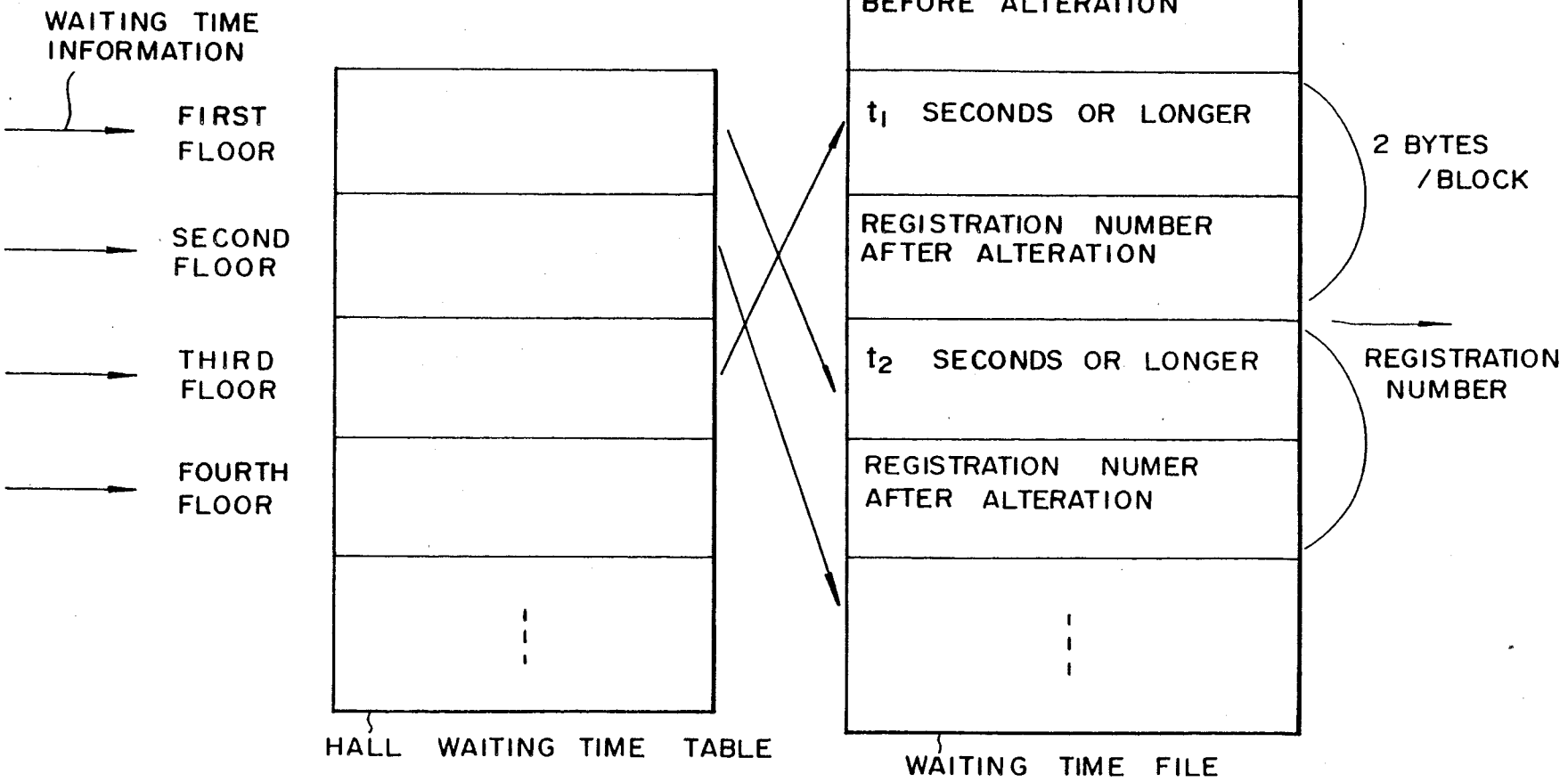
Figure 20:
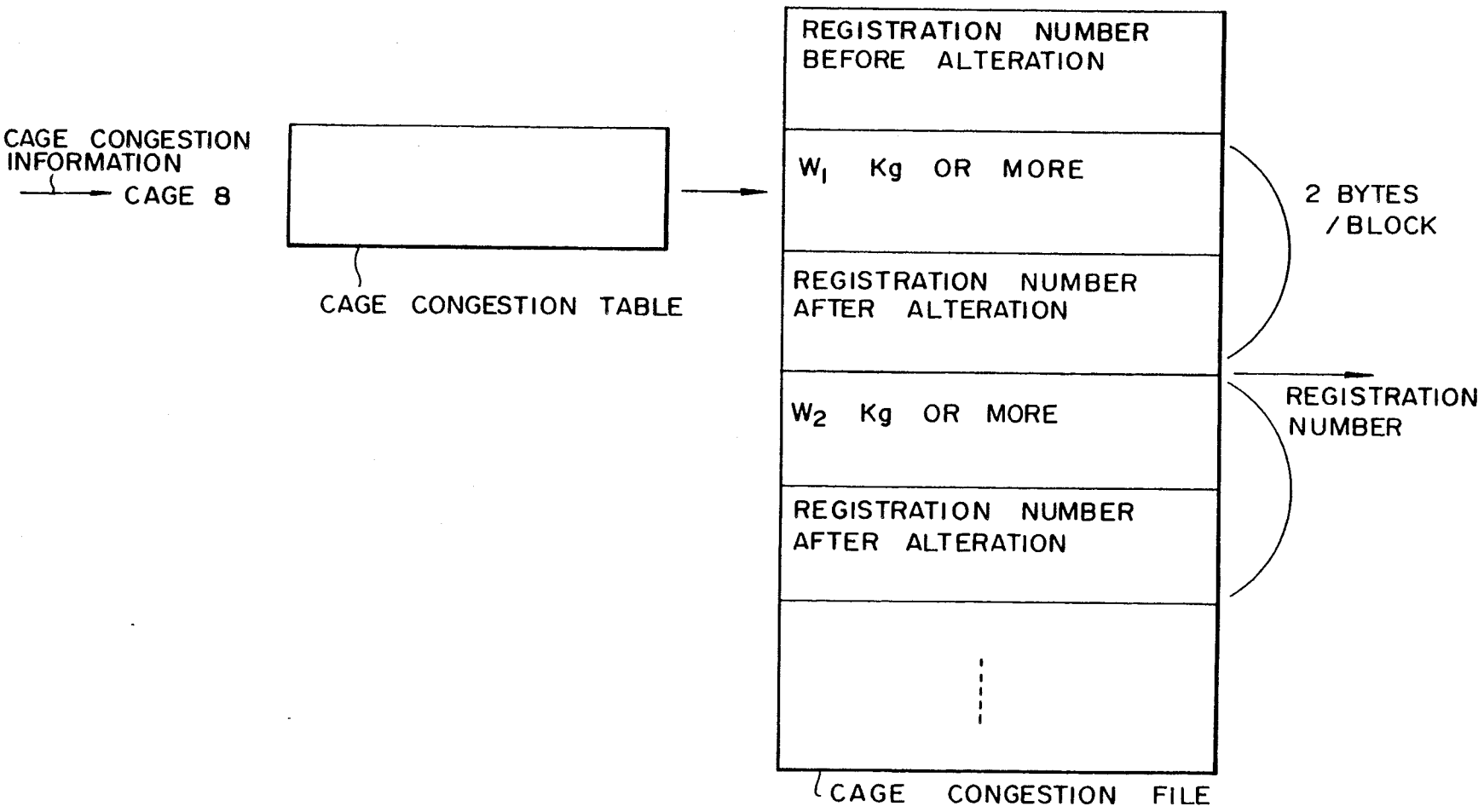

On the basis of the waiting time information of the elevator derived from the elevator control unit 10, waiting time is written into each floor of the hall waiting time table relating to the display unit number called beforehand and contained in the memory 1810 as shown in FIG. 19. From the waiting time file, the registration number after alteration and the registration number before alteration corresponding to the floor for which the waiting time is written are taken out. With respect to the registration number relating to the waiting time contained in the picture number taken out beforehand, a command using the registration number after alteration is issued. And such a command as to display the data of the picture number already taken out is issued. On the basis of the above described commands, the display unit performs display relating to the waiting time. In the above described processing, the hall waiting time table is rewritten and display on the display unit is altered whenever the elevator cage moves and the waiting time changes.

Lastly, the degree of congestion in the cage will now be described.

A cage congestion degree table is contained in the memory 1810. On the basis of the information supplied from the elevator control unit 10, the degree of congestion in the cage is written in the form of a total load of passengers in the cage, for example.

A cage congestion file is contained in the memory 1810. The registration number after alteration and the registration number before alteration of the current degree of congestion in the cage are taken out from the cage congestion file. With respect to the registration number for the cage congestion contained in the picture number already taken out, a command directing the use of the registration number after alteration is issued. And a command directing the display with the above described picture number is issued to the display unit.

Combination of general-purpose information and common information with the running information of the elevator will now be described.

Figure 21A:
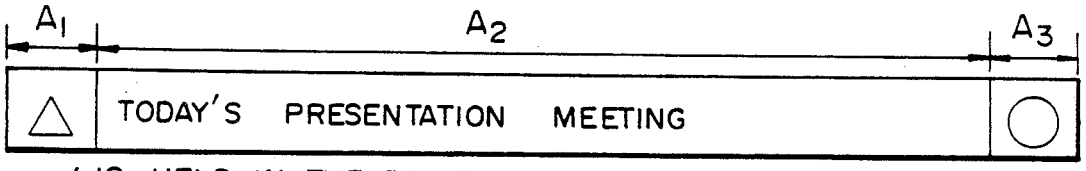
FIGS. 21A to 21C show one example of alteration of characters and figures displayed by the display unit of FIG. 4.
Figure 21A:
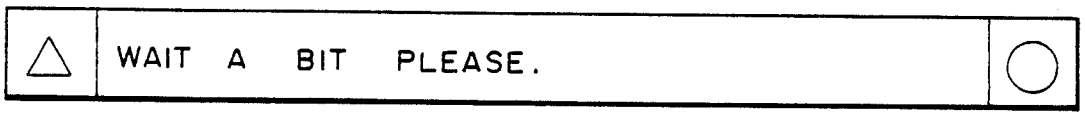
Figure 21B:
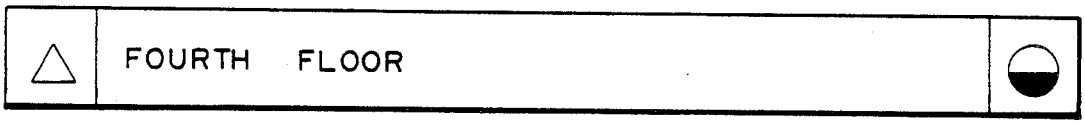
Figure 21C:
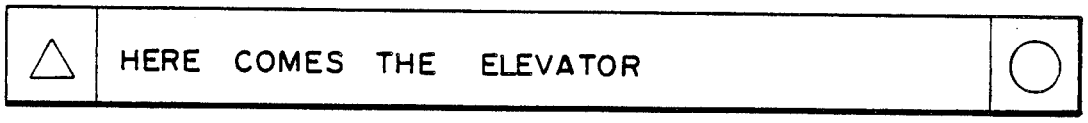

It is now assumed that the picture configuration as shown in FIGS. 21A to 21C is desired. Under the situation that there is some waiting time since a call button is depressed at a hall until the cage arrives at the hall, only the guidance display of the running direction and guidance of general-purpose information are performed as shown in FIG. 21A. When the elevator cage is near arrival, all of the running information is displayed as shown in FIG. 21B. When the cage has arrived at the hall where the call was generated, the running information of the elevator and general-purpose information are displayed as shown in FIG. 21C. The above described picture configuration is attained by taking out the picture number at each time from the time picture number retrieval file by means of the hall call floor table and the hall waiting time table and transmitting the picture number thus taken out to the display unit. In FIG. 21, $A_1$ denotes a region indicating the running direction of the cage, and $A_2$ denotes a region representing general-purpose information or running information. Further, $A_3$ denotes a region indicating the degree of congestion in the cage. Characters enclosed with parentheses are scroll-displayed contents.

Figure 22:
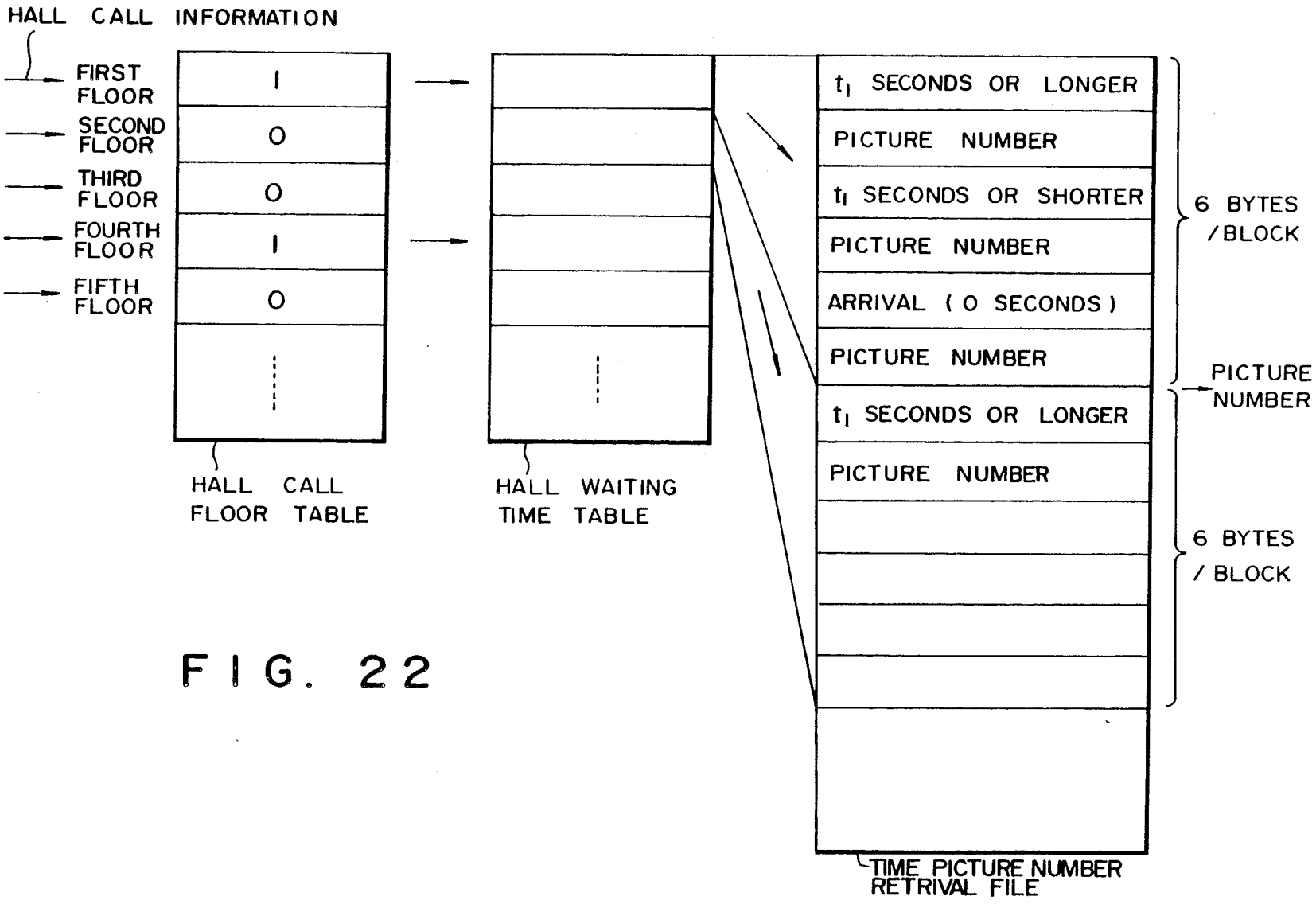
FIG. 22 shows relationship between table and file for deriving the example of display alteration shown in FIGS. 21A to 21C.

Even when it is desired to display respective information pieces separately, it becomes possible to perform display according to the waiting time, i.e., according to the position of the cage by altering the registration number of the display data corresponding to each picture number as shown in FIG. 22. An example thereof is shown in FIG. 23. FIG. 23A shows the case where the waiting time is $t_1$ or longer. FIG. 23B shows the case where the waiting time is not longer than $t_1$ and not shorter than $t_2$. And FIG. 23C shows the case where the waiting time is not longer than $t_2$ and not shorter than $t_3$.

Figure 24:
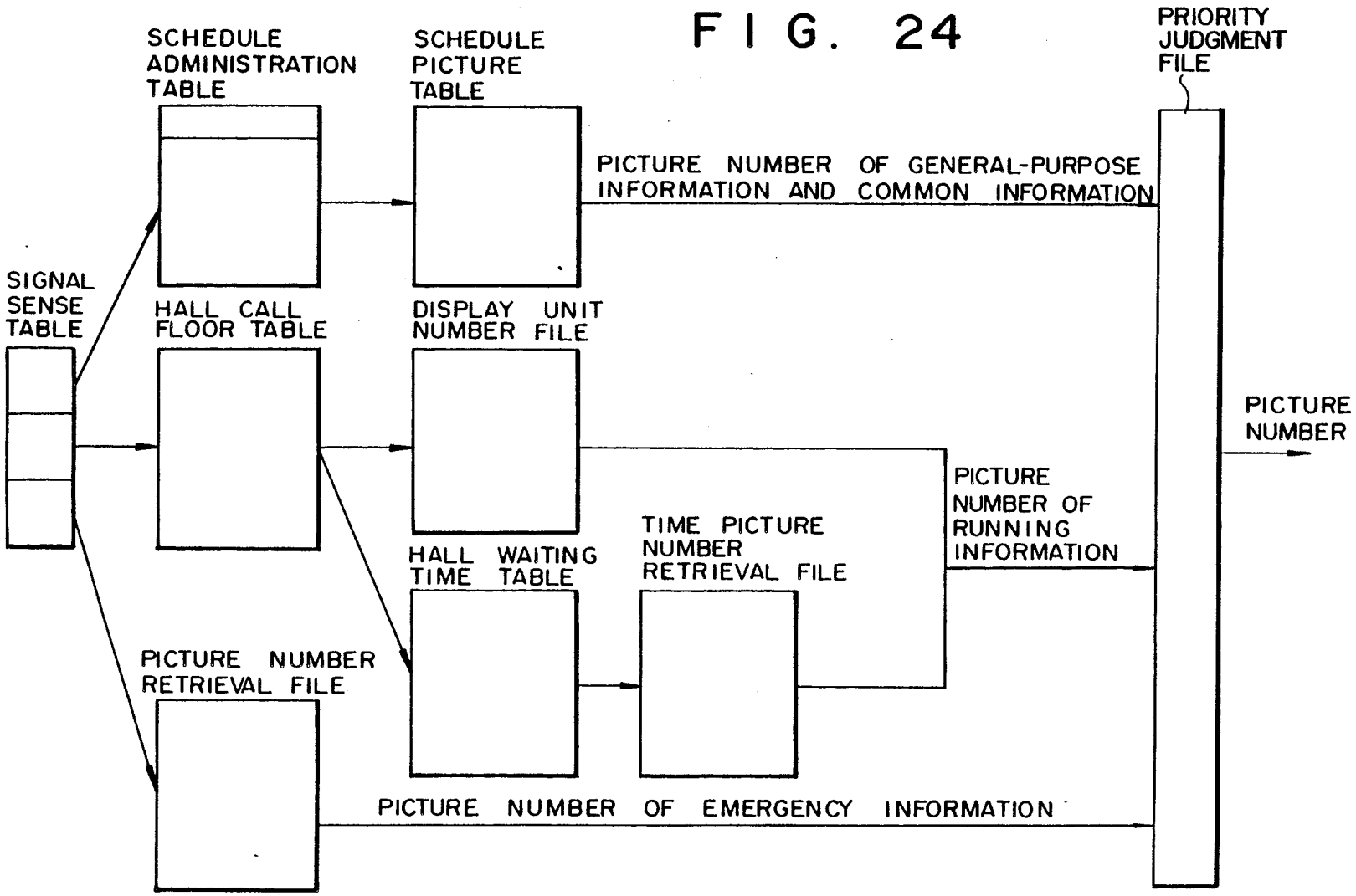
FIG. 24 shows an example of precedence judgment flow in case where the order of priority is given to information to be displayed.

FIG. 24 shows a display flow based upon priority judgment.

On the basis of a signal inputted from the elevator control unit 10, the MPU 1809 of the information display control unit 1800 hoists a flag on a signal sense table contained in the memory 1810. When the input is not present, a flag is hoisted at the position of input absence. When a flag is hoisted at the position of input absence, the picture number indicating the general-purpose information and common information and the display time are taken out from the schedule administration table and the schedule picture table as described before and sent to the priority judgment file. In this case, only the picture number of the general-purpose information and common information is transmitted. The picture number is transmitted to the display unit as it is.

In case the input supplied from the elevator control unit 10 is a hall call, the display unit number of the hall floor where a call is generated is taken out from the hall call floor table and the display unit number file as described before. Further, the picture number for the waiting time is taken out from the hall floor table, the hall waiting time table and the time picture number retrieval file as described before and is transmitted to the priority judgment file. In the priority judgment file, the picture number now on display is compared with the transmitted picture number. A picture number having a higher priority is selected and sent to the display unit. When a picture number having a high priority is transmitted, therefore, the picture on the display unit is altered. When a picture number having a low priority is transmitted, however, the displayed picture is not altered because the picture number is not altered by the priority judgment file.

When the display of the general-purpose information and common information based upon the schedule data is transferred to the display of the running information, a flag is hoisted at a position corresponding to the picture number now on display in the on-display flag column of the schedule administration table. When the display of the running information is completed and the display of the general-purpose information and common information is restored, display is continued from the picture number of the flag hoisted beforehand.

When an emergency situation occurs, a flag is hoisted at the emergency position of the signal sense file on the basis of the information supplied from the elevator control unit 10. Thereupon, the picture number of display relating to the emergency situation is taken out from the picture number retrieval file and transmitted to the priority judgment file. Since the emergency situation has the highest priority, that picture number is taken out in the priority judgment file and transmitted to the display unit.

Occurrence of the emergency situation is displayed by all of the display units relating to one cage. Therefore, the MPU 1809 transmits the picture number of emergency information to the display units in the order of priority. In case the emergency should be displayed in all cages, the information display control unit of each cage individually transmits the picture number to its own display units. When the emergency situation information input disappears, the flag of the pertinent position in the signal sense table is erased.

In the above described embodiment, IC cards are used. Instead, floppy disks (FD) or compact disks (CD) may be used. Since the IC card is small in size and has no movable portions, errors are not caused in data transmission. In case the information display control units are installed in a machine room, it is desirable for data transmission to use IC cards because dust is present more or less.

When these devices are used, displayed figures and characters can be replaced by simply mounting them on the information display control unit. Therefore, it is not necessary to produce various data by using the personal computer in the management room. The burden of the personal computer operator is thus reduced. In addition, it is possible to quickly respond to the opinion of passengers.

The information display control unit 1800 has an IC card reader. However, the boards 1801 and 1802 may be independent devices mutually coupled by a transmission path. In this case, the information display control unit corresponds to the board 1801, and the data input/output unit corresponds to the board 1802.

The light emission devices on the display panel are not restricted to LEDs, but various devices such as electroluminescence (EL) devices and liquid crystal devices may be used.

If voices are broadcasted when general information and running information of the elevator are displayed or are being displayed on the display panel 2407 shown in FIG. 4, the attention of passengers is drawn to the display panel and the information transmission effect of the display is enhanced.

Configuration for broadcasting the voices as well will now be described in brief.

A connector similar to the connector 1813 of the IC card 22 for display is disposed on the board 1802 of the information display control unit 1800 of FIG. 2, and an IC card for storing voice data is inserted into the connector thus disposed. The memory 1816 contains control program for transmitting a part of voice data stored on the voice IC card. In the display unit 2400, a voice synthesis circuit is connected to the bus 2403, and a speaker is connected to the voice synthesis circuit. The voice data comprise schedule data and broadcast data. The schedule data are stored into the memory 1810 of the information display control unit 1800, whereas the broadcast data are stored into the memory 2405 of the display unit 2400. The schedule data change depending upon schedule data change depending upon whether a composition is broadcasted or arousing tone is broadcasted. The arousing tone is preferably broadcasted prior to display. In case of the composition broadcast, it is performed after display or according to the display speed. In order to attain such harmony between display and broadcast, a display time counter is provided in the MPU 1809 of the board 1801 shown in FIG. 2. Timing of the broadcast and display is based upon the counter, and directives of broadcast and display are issued from the information control unit 1800 to the display unit 2400.

Figure 25:
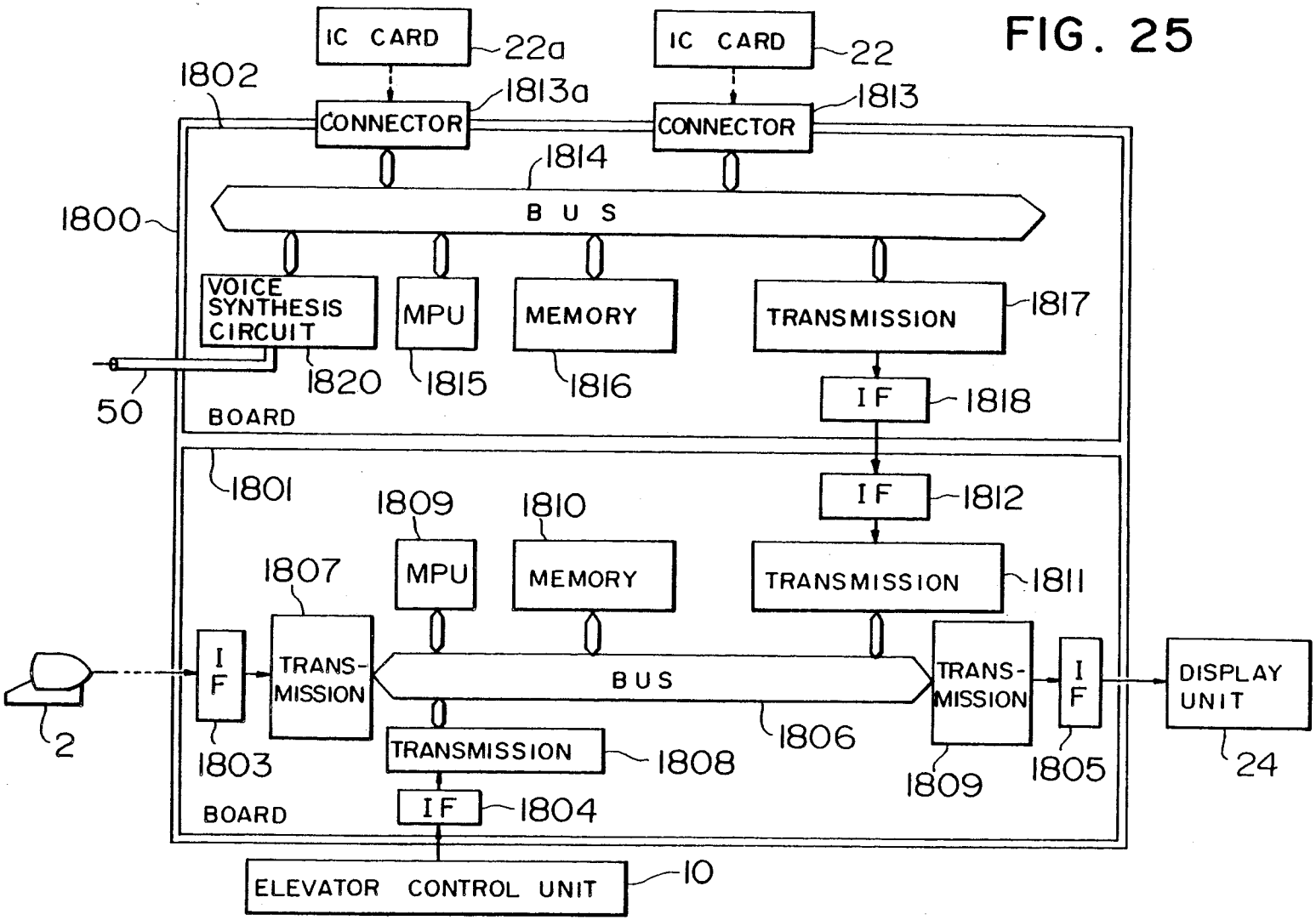
Figure 26:
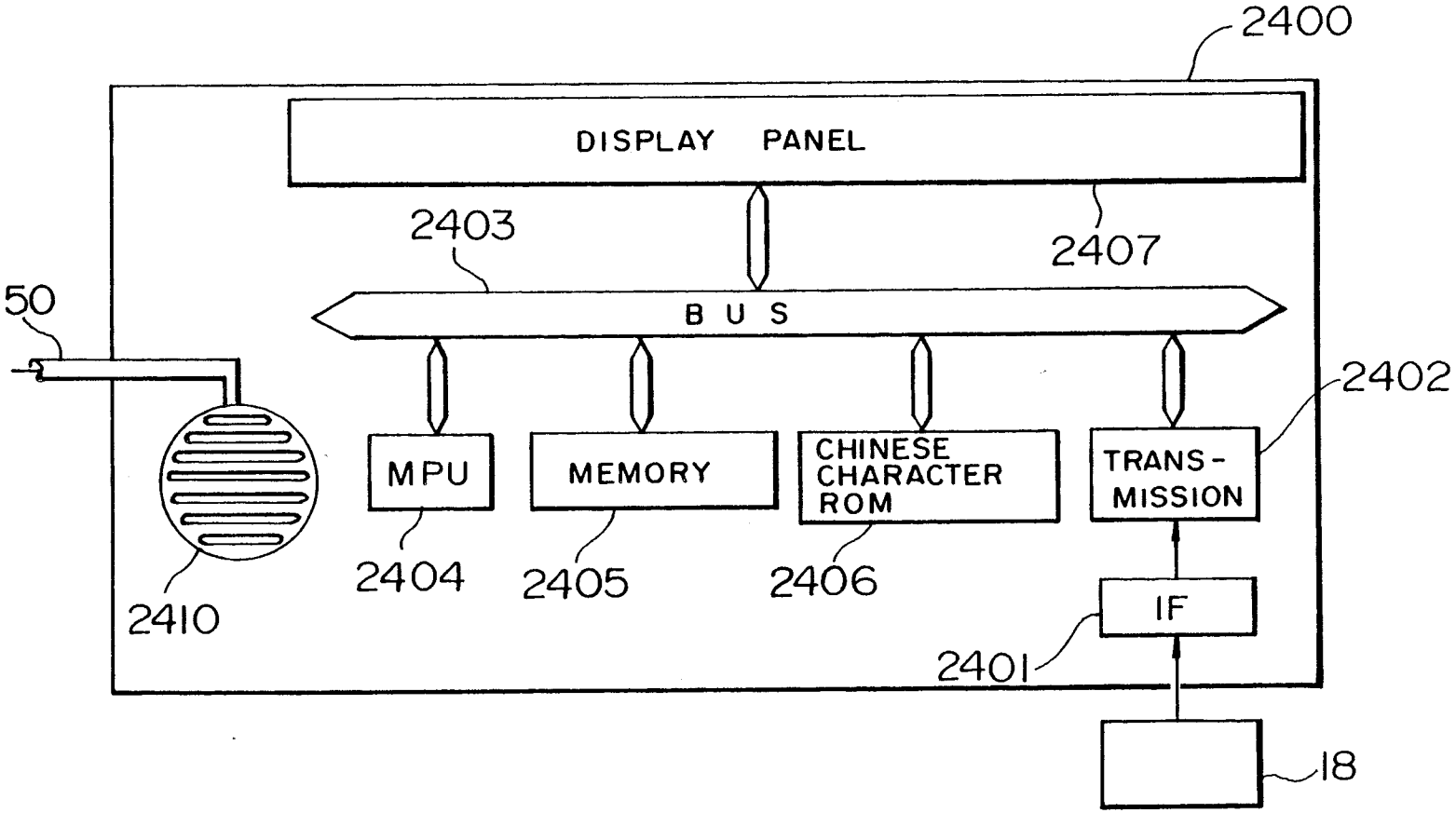

In a variant of the above described configuration for broadcasting voices, a voice synthesis circuit 1820 is disposed on the board 1802 shown in FIG. 25, and a speaker 2410 is disposed in the display unit 2400 shown in FIG. 26. The voice synthesis circuit 1820 is connected to the speaker 2410 via a cable 50. An IC card **22*a* for voices is attached to the board 1802 via a connector 1813*a*. Schedule data and broadcast data are stored in the memory 1816 of the board 1802. Program of the voice broadcast and display is stored in the memory 1816, and the broadcast and display are performed in accordance with the program. This has an advantage that the amount of data transmitted to the display unit 2400** is reduced.

Since display is given in synchronism with voices, passengers do not miss seeing the service information and receive sufficient information service.

The broadcasted composition may have contents similar to those represented by characters displayed on the display panel 407. Especially in case of graphic representation, audio output of language help passengers to understand the meaning of displayed picture patterns, resulting in significantly enhanced service effect.

As described heretofore, the present invention makes it possible to alter easily the display format and quickly perform display according to the opinion of passengers.

We claim:

1. An elevator display guide apparatus comprising an elevator control unit, an information production unit and an information display control unit, said elevator display guide apparatus displaying running information of an elevator and general information on display units at least disposed in halls according to a running situation of the elevator, wherein:

the information display control unit is so configured that an auxiliary memory medium storing information required to display the running information of the elevator may be mounted thereon;

the information display control unit derives information required to display the running information of the elevator from said auxiliary memory medium;

the information display control unit derives information required to display general information from the information production unit; and the running information of the elevator and general information are displayed on display units at least disposed in halls according to information relating to the running situation of the elevator derived from the elevator control unit.

2. An elevator display guide apparatus according to claim 1, wherein the auxiliary memory medium comprises one of an IC card, a floppy disk and a compact disk.

3. An elevator display guide apparatus according to claim 1, wherein the auxiliary memory medium stores therein display data, display picture edit data and file data as information required to display the running information of an elevator, and the information display control unit selects information to be displayed out of a table disposed in the information display control unit to store information relating to the running situation of the elevator derived from the elevator control unit and a file derived from said auxiliary memory medium.

4. An elevator display guide apparatus according to claim 1, wherein the information display control unit includes data input and output means for taking out information required to display the running situation of an elevator as stored in the auxiliary memory medium.

5. An elevator display guide apparatus according to claim 1, wherein the information display control unit has a voice synthesizing unit and is so configured that an auxiliary memory medium storing data required to broadcast voices may be mounted thereon, and said display unit has a speaker and outputs voices in synchronism with a guidance display.

6. An elevator display guide apparatus comprising an elevator control unit, an information production unit and an information display control unit, said elevator display guide apparatus displaying running information of an elevator and general information on a display unit at least disposed in halls according to a running situation of the elevator, wherein:

the information display control unit is so configured that an auxiliary memory medium storing information required to display the running information of the elevator in a digital code form may be mounted thereon;

the information display control unit derives information required to display the running information of the elevator from said auxiliary memory medium;

the information display control unit derives digital-coded information required to display general information from the information production unit; and the running information of the elevator and general information are displayed on display units at least disposed in halls according to information relating to the running situation of the elevator supplied from the elevator control unit.

7. An elevator display guide apparatus comprising an elevator control unit, an information production unit and an information display control unit, said elevator display guide apparatus displaying running information of an elevator and general information on display units at least disposed in halls according to a running situation of the elevator, wherein:

said information display control unit derives information required to display at least the running information of an elevator and represented in a digital signal form from an auxiliary memory medium and deriving information required to display general information and represented in a digital signal form from the information production unit;

said information display control unit selects digital signals relating to information to be displayed out of information thus derived, and transmits the digital signals thus selected to a display unit to store the digital signals therein;

said information display control unit stores digital signals for a display command in its own memory and issues a command for making the display unit display the running information of the elevator and general information according to a situation of the elevator running supplied from the elevator control unit; and the display unit receives said command, takes out digital signals corresponding to said command from digital signals relating to information transmitted beforehand to be displayed, and produces a predetermined display.

8. An elevator display guide apparatus comprising an elevator control unit, an information production unit and an information display control unit, said elevator display guide apparatus displaying running information of an elevator and general information on display units at least disposed in halls according to a running situation of the elevator, wherein:

said information display control unit derives information required to display at least the running information of an elevator from an auxiliary memory medium as digital codes and derives information required to display general information from the information production unit as digital codes;

said information display control unit selects digital codes relating to information to be displayed out of information thus derived, transmits the digital codes to a display unit, and stores the digital codes derived from the auxiliary memory medium and the digital code derived from the information production unit separately into a memory of the display unit;

said information display control unit stores digital codes for issuing a display command derived from the auxiliary memory medium and digital codes for issuing a display command derived from the information production unit separately into its own memory;

said information display control unit issues a command for making the display unit display the running information of the elevator and general information according to information relating to a running situation of the elevator derived from the elevator control unit; and the display unit takes out digital codes corresponding to said command, on the basis of said command, from digital signals relating to information supplied beforehand to be displayed and stored in the memory, and produces a predetermined display on the basis of digital codes thus taken out.

9. An elevator display guide apparatus comprising an elevator control unit, an information production unit and an information display control unit, said elevator display guide apparatus displaying running information of elevator and general information on display units at least disposed in respective halls according to running situation of elevator, wherein:

the information display control unit is so configured that an auxiliary memory medium storing information required to display the running information of an elevator may be mounted thereon;

the information display control unit derives information required to display the running information of the elevator from said auxiliary memory medium;

the information display control unit derives information required to display general information from the information production unit;

the information display control unit successively selects a display unit out of a plurality of display units at least disposed in halls; and the display unit thus selected displays the running information of the elevator and general information according to information relating to the running situation of the elevator derived from the elevator control unit.

10. An elevator display guide apparatus comprising an elevator control unit, an information display control apparatus and a display unit, said elevator display guide apparatus displaying information on the display unit according to a running situation of the elevator, wherein:

the information display control unit is provided with an auxiliary memory medium which is detachably provided on the information control unit for storing information required to be displayed;

the information display control unit includes means for transmitting information required for display from the auxiliary memory medium to the display unit according to information relating to the running situation of the elevator as derived from the elevator control unit; and the display unit displays the information received from said auxiliary memory medium to perform guidance display.

11. An elevator display guide apparatus according to claim 10, wherein the display control unit is so configured that an auxiliary memory medium storing voice data may be mounted thereon, and a display unit has a speaker and outputs voices in synchronism with a guidance display.

12. A display method for elevator display guide apparatus including an elevator control unit, an information display control unit, said elevator display guide apparatus displaying running information of elevator and general information on display units at least disposed in halls according to running situation of an elevator, comprising:

the information display control unit deriving information required to display the running information of the elevator from an auxiliary memory medium mounted on the information display control unit;

the information display control unit deriving information required to display general information from the information production unit; and the running information of the elevator and general information being displayed on display units at least disposed in halls according to information relating to the running situation of the elevator derived from the elevator control unit.

13. A display method for elevator display guide apparatus according to claim 12, wherein the auxiliary memory medium comprises one of an IC card, a floppy disk and a compact disk.

14. A display method for elevator display guide apparatus according to claim 12, wherein the auxiliary memory medium stores therein display data, display picture edit data and file data as information required to display the running information of an elevator, and the information display control unit selects information to be displayed out of a table disposed in the information display control unit to store information relating to the running situation of the elevator derived from the elevator control unit and a file derived from said auxiliary memory medium.

15. A display method for elevator display guide apparatus according to claim 12, wherein the information display control unit includes data input and output means for taking out information required to display the running situation of the elevator stored in the auxiliary memory medium.

16. A display method for elevator display guide apparatus according to claim 12, wherein the information display control unit derives data required to broadcast voices from a second auxiliary memory medium mounted thereon, makes display units at least disposed in halls display the running information of elevator and general information according to information relating to the running situation of elevator derived from the elevator control unit, and broadcasts voices through speakers disposed in the display units in synchronism said display.

17. A display method for elevator display guide apparatus including an elevator control unit, an information production unit and an information display control unit, said elevator display guide apparatus displaying running information of an elevator and general information on display units at least disposed in halls according to running situation of the elevator, comprising:

said information display control unit deriving information required to display the running information of the elevator and represented in a digital signal form from an auxiliary memory medium mounted thereon and deriving information required to display general information and represented in a signal form from the information production unit;

the running information of the elevator and general information being displayed on display units at least disposed in halls according to information relating to the running situation of the elevator derived from the elevator control unit.

18. A display method for elevator display guide apparatus including an elevator control unit, an information production unit and an information display control unit, said elevator display guide apparatus displaying running information of an elevator and general information on display units at least disposed in halls according to running situation of the elevator, comprising:

said information display control unit deriving information required to display at least the running information of the elevator and represented in a digital signal form from an auxiliary memory medium and deriving information required to display general information and represented in a digital signal form from the information production unit;

said information display control unit selecting digital signals relating to information to be displayed out of information thus derived, and transmitting the digital signals thus selected to a display unit to store the digital signals therein;

said information display control unit storing digital signals for issuing a display command in its own memory and issuing a command for making the display unit display the running information of the elevator and general information according to situation of the elevator running supplied from the elevator control unit; and the display unit receiving said command, taking out digital signals corresponding to said command from digital signals relating to information transmitted beforehand to be displayed, and performing predetermined display.

19. A display method for elevator display guide apparatus including an elevator control unit, an information production unit and an information display control unit, said elevator display guide apparatus displaying running information of an elevator and general information on display units at least disposed in halls according to running situation of the elevator, comprising:

said information display control unit deriving information required to display at least the running information of the elevator from an auxiliary memory medium as digital codes and deriving information required to display general information from the information production unit as digital codes;

said information display control unit selecting digital codes relating to information to be displayed out of information thus derived, transmitting the digital codes to a display unit, and storing the digital codes derived from the auxiliary memory medium and the digital code derived from the information production unit separately into a memory of the display unit;

said information display control unit storing digital codes for issuing a display command derived from the auxiliary memory medium and digital codes for issuing a display command derived from the information production unit separately into its own memory;

said information display control unit issuing a command for making the display unit display the running information of the elevator and general information according to information relating to running situation of elevator derived from the elevator control unit; and the display unit taking out digital codes corresponding to said command, on the basis of said command, from digital signals relating to information supplied beforehand to be displayed and stored in the memory, and producing a predetermined display on the basis of digital codes thus taken out.

20. A display method for elevator display guide apparatus including an elevator control unit, an information production unit and an information display control unit, said elevator display guide apparatus displaying running information of an elevator and general information on display units at least disposed in respective halls according to running situation of the elevator, comprising:

the information display control unit deriving information required to display the running information of the elevator from an auxiliary memory medium mounted thereon;

the information display control unit deriving information required to display general information from the information production unit;

the information display control unit successively selecting a display unit out of a plurality of display units at least disposed in halls; and the display unit thus selected displaying the running information of the elevator and general information according to information relating to the running situation of the elevator derived from the elevator control unit.

21. A display method for elevator display guide apparatus including an elevator control unit, an information display control unit, said elevator display guide apparatus displaying running information of an elevator and general information on display units at least disposed in halls according to running situation of the elevator, comprising:

the information display control unit deriving information required to display the running information of the elevator from an auxiliary memory medium mounted on the information display control unit;

the information display control unit deriving information required to display general information from the information production unit; and general information being displayed on display units at least disposed in halls in accordance with predetermined schedule in case information relating to running situation of the elevator is not available from the elevator control unit.

22. A display method for elevator display guide apparatus including an elevator control unit, an information display control unit, said elevator display guide apparatus displaying running information of an elevator and general information on display units at least disposed in halls according to running situation of the elevator, comprising:

the information display control unit deriving information required to display the running information of the elevator from an auxiliary memory medium mounted on the information display control unit;

the information display control unit deriving information required to display general information from the information production unit; and the information display control unit making display units at least disposed in halls display the running information of the elevator and general information in the order of priority supplied to the information and according to information relating to running situation of the elevator derived from the elevator control unit.

23. A display method for elevator display guide apparatus including an elevator control unit, an information display control unit, and a display unit, said information display control unit displaying information on the display unit according to information relating to running situation of an elevator derived from the elevator control unit, comprising:

said information display control unit deriving information required for display from an auxiliary memory medium which is detachably mounted thereon; and said information display control unit issuing a display command to the display unit on the basis of information relating to a running situation of the elevator derived from the elevator control unit.

24. A display method for elevator display guide apparatus according to claim 23, wherein said information display control unit derives information required for broadcasting voices from an auxiliary memory medium mounted thereon, and issues a command for outputting voices through a speaker disposed in the display unit in synchronism with display.

* * * * *